US008287064B2

(12) United States Patent
Akatsuka et al.

(10) Patent No.: US 8,287,064 B2
(45) Date of Patent: Oct. 16, 2012

(54) LIQUID EJECTING APPARATUS

(75) Inventors: Yasushi Akatsuka, Asahi-mura (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 362 days.

(21) Appl. No.: 12/571,171

(22) Filed: Sep. 30, 2009

(65) Prior Publication Data

US 2010/0079517 A1 Apr. 1, 2010

(30) Foreign Application Priority Data

Sep. 30, 2008 (JP) ..... 2008-252652
Oct. 23, 2008 (JP) ..... 2008-272809
Aug. 18, 2009 (JP) ..... 2009-188938
Aug. 18, 2009 (JP) ..... 2009-188939

(51) Int. Cl.
*B41J 2/195* (2006.01)
*B41J 2/17* (2006.01)
*B41J 2/175* (2006.01)
*B41J 29/38* (2006.01)

(52) U.S. Cl. ..... 347/7; 347/84; 347/85; 347/86; 347/5

(58) Field of Classification Search ..... 347/5–7, 347/114, 19, 84–86
See application file for complete search history.

(56) References Cited

U.S. PATENT DOCUMENTS 3,930,258 A * 12/1975 Dick et al. ..... 347/7
5,847,736 A * 12/1998 Kanbayashi et al. ..... 347/89
7,628,478 B2 * 12/2009 Inoue ..... 347/85

FOREIGN PATENT DOCUMENTS

| | | |
|---|---|---|
| JP | 05-092578 | 4/1993 |
| JP | 09-234886 | 9/1997 |
| JP | 09-327927 | 12/1997 |
| JP | 10-146989 | 6/1998 |
| JP | 11-348300 | 12/1999 |
| JP | 2006-110937 | 4/2006 |
| JP | 2006-168023 | 6/2006 |
| WO | 95/31335 | 11/1995 |

* cited by examiner

*Primary Examiner* — Stephen Meier
*Assistant Examiner* — Sarah Al Hashimi
(74) *Attorney, Agent, or Firm* — Workman Nydegger

(57) ABSTRACT

A liquid ejecting apparatus includes a first liquid containing unit containing a liquid therein and a second detachable liquid containing unit containing a liquid therein and having a liquid containing volume smaller than that of the first liquid containing unit. A communication passage communicates the first liquid containing unit with the second liquid containing unit. The first and second liquid containing units are reciprocally replenished with the liquid by a liquid replenishing unit through the communication passage. When the liquid is replenished from the first or second liquid containing units to the other, a control unit controls the liquid replenishing unit to replenish the liquid from the one liquid containing unit to the other liquid containing unit, until the liquid contained in the one liquid containing unit reaches a predetermined amount smaller than the liquid containing volume of the second liquid containing unit.

8 Claims, 19 Drawing Sheets

LIQUID EJECTING APPARATUS

BACKGROUND

1. Technical Field

The present invention relates to a liquid ejecting apparatus having a function of agitating a liquid.

2. Related Art

As ink to be used in a liquid ejecting apparatus, for example, a printer device, there is known ink using a color component which is not dissolved by a solvent or is nearly insoluble in the solvent. For example, pigment-based ink contains fine particles of pigment which are a color component and are dispersed in a solvent such as water or petroleum solvent, and the pigment is likely to be settled down. For example, specific gravity of white pigment is approximately 4 and specific gravity of metallic pigment is approximately 2 to 3, but specific gravity of the solvent is less than 1. Because of a difference in the specific gravity between the pigment and the solvent, the pigment is easily separated from the solvent and is precipitated. Also, in the case of the ink using insoluble or hardly-soluble dye as a color component, the dye is likely to be precipitated. If the color component is precipitated, shading occurs in the ink, so that ink of uniform concentration is not fed to the head. There is a problem that a dense portion of the ink does not fall in drops from a nozzle of the head, so that the nozzle is likely clogged, or brightness of a dot is changed.

It is known that the ink is moved and agitated to prevent sedimentation of the color component. For example, a technique of providing a first ink containing unit (i.e., an ink tank) and a second ink containing unit and reciprocating the ink between two ink containing units is known (e.g., JP-A-9-327929, WO95/31335, and JP-A-9-234886).

In the above-mentioned publications, however, the ink is moved between two ink containing units due to difference in height, that is, a water head difference, between a liquid level of the ink filled in the first ink containing unit and a liquid level of the ink filled in the second ink containing unit. In other words, only a portion of the ink reciprocates between two ink containing units, and thus only the portion is agitated. For this reason, the ink remaining in the ink containing units is insufficiently agitated, and thus it does not prevent sedimentation of the color component of the ink in the ink containing units.

SUMMARY

An advantage of some aspects of the invention is to provide a liquid ejecting apparatus capable of preventing precipitate or adhesion of a liquid and sedimentation of a color component of the liquid and also preventing idle striking operation of the liquid in a head, without installing an agitating unit in a liquid containing unit.

An aspect of the invention is to provide a liquid ejecting apparatus including: a first liquid containing unit containing a liquid therein; a second detachable liquid containing unit containing a liquid therein and having a liquid containing a volume smaller than that of the first liquid containing unit; a communication passage that communicates the first liquid containing unit with the second liquid containing unit, in which the first liquid containing unit and the second liquid containing unit are reciprocally replenished with the liquid via the communication passage; a liquid replenishing unit that replenishes the liquid between the first liquid containing unit and the second liquid containing unit via the communication passage; and a control unit that, when the liquid is replenished from any one of the first and second liquid containing units to the other, controls the liquid replenishing unit so as to replenish the liquid from the one liquid containing unit to the other liquid containing unit, until the liquid contained in the one liquid containing unit reaches a predetermined amount smaller than the liquid containing volume of the second liquid containing unit. By supplying the liquid from the one liquid containing unit to the other liquid containing unit via the communication passage, the liquid filled in both liquid containing units and the communication passage is agitated. Therefore, it is possible to prevent precipitate or adhesion of the liquid or sedimentation of the color component of the liquid, in the case where the agitating unit is not installed in the liquid containing units. Also, the first liquid containing unit has a liquid containing volume larger than that of the second liquid containing unit. Therefore, for example, even after the second liquid containing unit is left for a long time in the state a remainder of the ink is large, it is possible to be sure of agitating the liquid contained in the second liquid containing unit by replenishing the first liquid containing unit with the total amount of the liquid contained in the second liquid containing unit.

Whenever the liquid replenishing unit replenishes the liquid between the respective liquid containing units, the control unit judges whether or not the liquid filled in the one liquid containing unit is the predetermined amount, and controls the liquid replenishing unit based on the judged result. Since the agitating effect of the liquid is obtained whenever the liquid is supplied between both liquid containing units, it is possible to be sure of preventing sedimentation or adhesion of the liquid, and sedimentation of the color component of the liquid.

In the case where the liquid replenishing unit replenishes the liquid between the respective liquid containing units, whenever the number of replenishments reaches a predetermined number or reciprocal replenishments reaches a predetermined time, the control unit judges whether or not the liquid filled in the one liquid containing unit is the predetermined amount, and controls the liquid replenishing unit based on the judged result. Since the agitating operation is sufficiently carried out with respect to the liquid while changing the replenishing operation of the liquid which is carried out between both liquid containing units, it is possible to be sure of preventing sedimentation or adhesion of the liquid, and sedimentation of the color component of the liquid.

When liquid replenishing unit replenishes the liquid between the respective liquid containing units, the control unit controls the liquid replenishing unit in such a way that a desired amount after the number of replenishments reaches a predetermined number is less than the desired amount before the number of the replenishments reaches the predetermined number, thereby changing the replenishing operation of the liquid which is carried out between both liquid containing units. More specifically, before the number of replenishments of the liquid reaches the predetermined number, the predetermined amount is set high as compared to the predetermined amount after the number of replenishments of the liquid reaches the predetermined number, so that it is possible to increase the number of replenishing operations of the liquid carried out between both liquid containing units. Meanwhile, after the second liquid containing unit is exchanged and before the number of replenishments of the liquid reaches the predetermined number, it is assumed that the total amount of the liquid contained in both liquid containing units and the communication passage is relatively increased. With the above configuration, it is possible to suppress deterioration of the number of replenishing operations of the liquid which is carried out between both liquid containing units, even in the above instance.

The control unit controls the liquid replenishing unit in such a way that the predetermined amount is gradually decreased in accordance with consumption of the liquid. Therefore, immediately after the second liquid containing unit is exchanged, it is possible to stop the number of replenishing operations of the liquid which is carried out between both liquid containing units from decreasing, even though the total amount of the liquid contained in both liquid containing units and the communication passage is relatively large. Also, if the total amount of the liquid contained in both liquid containing units and the communication passage is decreased with the consumption of the liquid, the predetermined amount is set to be gradually decreased. Thus, a ratio of the liquid supplied to the other liquid containing unit to the liquid contained in the one liquid containing unit is gradually increased. Therefore, the agitating operation of the liquid can be surely carried out by the replenishing operation of the liquid between both liquid containing units.

The control unit controls the liquid replenishing unit in such a way that the predetermined amount in the case where the first liquid containing unit replenishes the second liquid containing unit with the liquid differs from the predetermined amount in the case where the second liquid containing unit replenishes the first liquid containing unit with the liquid. For example, the total amount of the liquid contained in the one liquid containing unit is supplied to the other liquid containing unit, and only a part of the liquid contained in the other liquid containing unit is supplied to the one liquid containing unit. In this instance, the liquid contained in the one liquid containing unit is agitated more surely than the liquid contained in the other liquid containing unit. In other words, with the above configuration, it is possible to agitate intensively the liquid contained in any one of the first liquid containing unit and the second liquid containing unit, by properly setting the predetermined amount.

Another aspect of the invention is to provide a liquid ejecting apparatus including: a first liquid containing unit containing a liquid therein; a second detachable liquid containing unit containing a liquid therein and having a liquid containing volume smaller than that of the first liquid containing unit; a communication passage that communicates the first liquid containing unit with the second liquid containing unit, in which the first liquid containing unit and the second liquid containing unit are reciprocally replenished with the liquid via the communication passage; a liquid replenishing unit that replenishes the liquid between the first liquid containing unit and the second liquid containing unit via the communication passage; a control unit that, when the liquid is supplied from any one of the first and second liquid containing units to the other, controls the liquid replenishing unit to replenish the liquid from the one liquid containing unit to the other liquid containing unit, until the liquid contained in the one liquid containing unit reaches a predetermined amount smaller than the liquid containing volume of the second liquid containing unit; a detecting unit that detects an amount of the liquid contained in the liquid containing unit of any one of the first liquid containing unit and the second liquid containing unit, or an amount of the liquid flowing through the communication passage; and a judging unit that judges the total amount of the liquid filled in the respective liquid containing units based on an output of the detecting unit, wherein the control unit performs stop control of the operation of reciprocal replenishment based on a judged result of the judging unit, and in the stop control, the operation is stopped in a state where the liquid remains in any one of liquid containing unit of the first liquid containing unit and the second liquid containing unit. Therefore, the liquid ejecting apparatus includes an ink agitating function, so that the pigment and solvent are sufficiently agitated to prevent discoloration. Also, when the total amount of the liquid reaches a predetermined remaining amount, the reciprocal replenishment stops or an end display is performed. A predetermined remaining amount of the liquid can remain in any one of the first and second liquid containing units as the total amount of the liquid. Since the remaining amount of the ink is consumed by the head even after the operation of reciprocal replenishment stops, it is possible to prevent the idle striking operation in the head. Further, it is possible to prevent precipitate or adhesion of the ink and the sedimentation of the ink by the agitation resulting from the reciprocal replenishment. Also, a predetermined remaining amount of the liquid can remain in any one of the first liquid containing unit and the second liquid containing unit. Thus, the remaining amount of the liquid can be consumed by the head, and it is possible to be sure of preventing the idle striking operation of the liquid in the head.

The control unit transfers the liquid contained in the second liquid containing unit to the first liquid containing unit immediately after the operation of reciprocal replenishment stops or when the operation of reciprocal replenishment stops, so that the liquid contained in the second liquid containing unit becomes an empty state or a near empty state. Therefore, since the liquid does not remain in the second liquid containing unit to be exchanged, it is possible to prevent the liquid remained in the second liquid containing unit from wastefully throw away, when the second liquid containing unit is wasted at the exchange.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
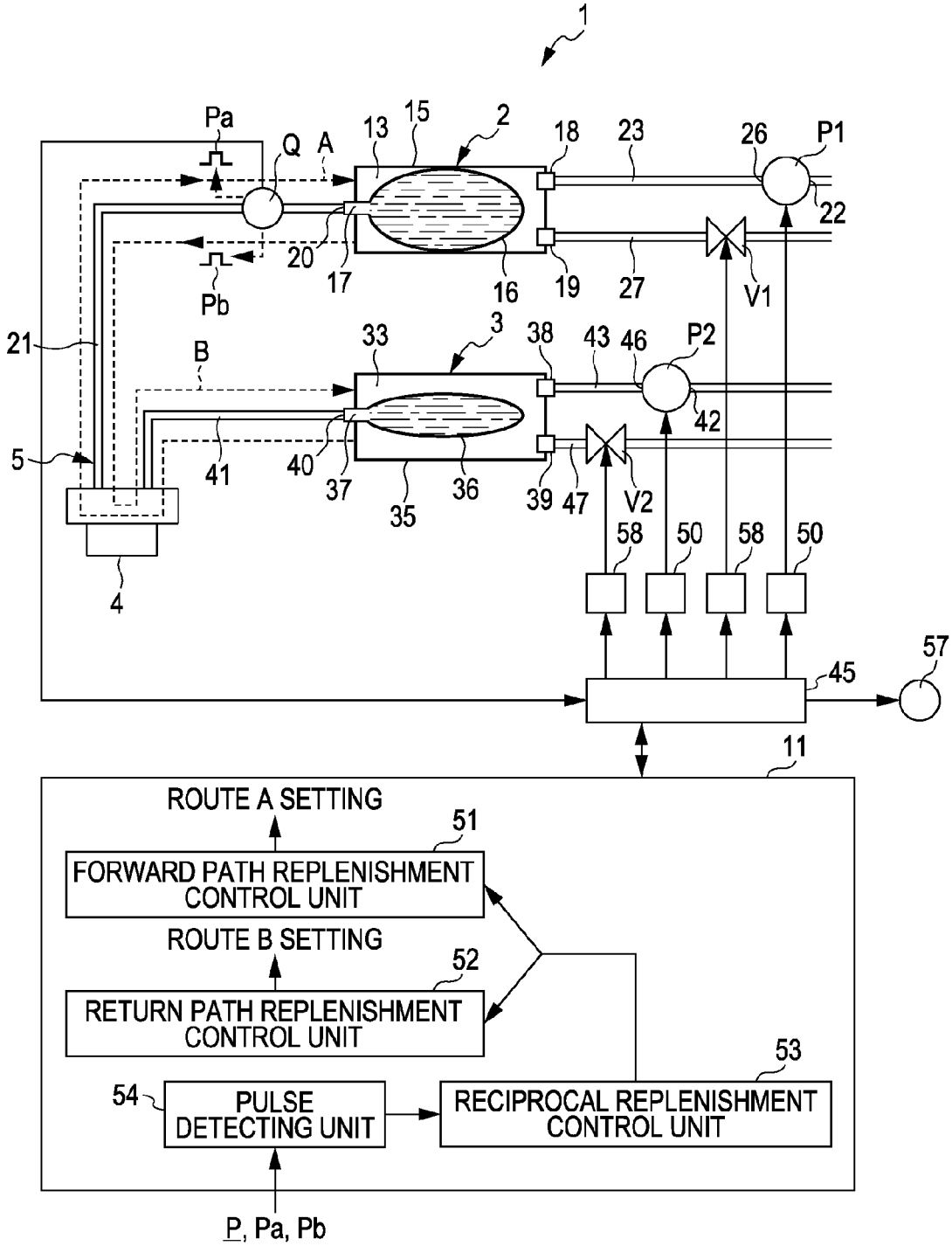
FIG. 1 is a view showing the configuration of a printer device according to a first embodiment of the invention.
Figures 2A, 2B:
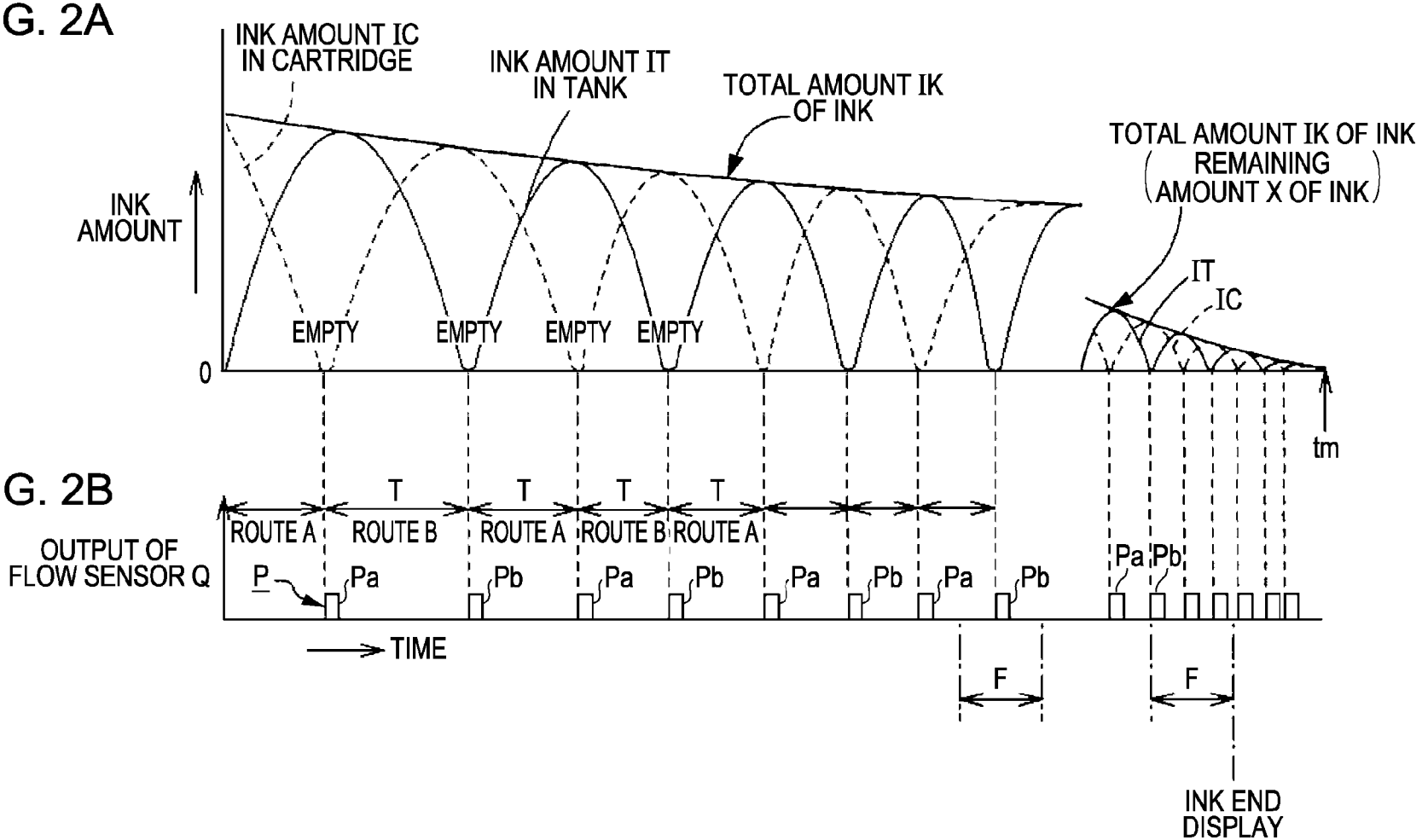
FIGS. 2A and 2B are views showing a relation between a fluctuation of an amount of ink contained in a cartridge and in a tank and an output of a flow sensor according to the first embodiment of the invention.
Figure 3:
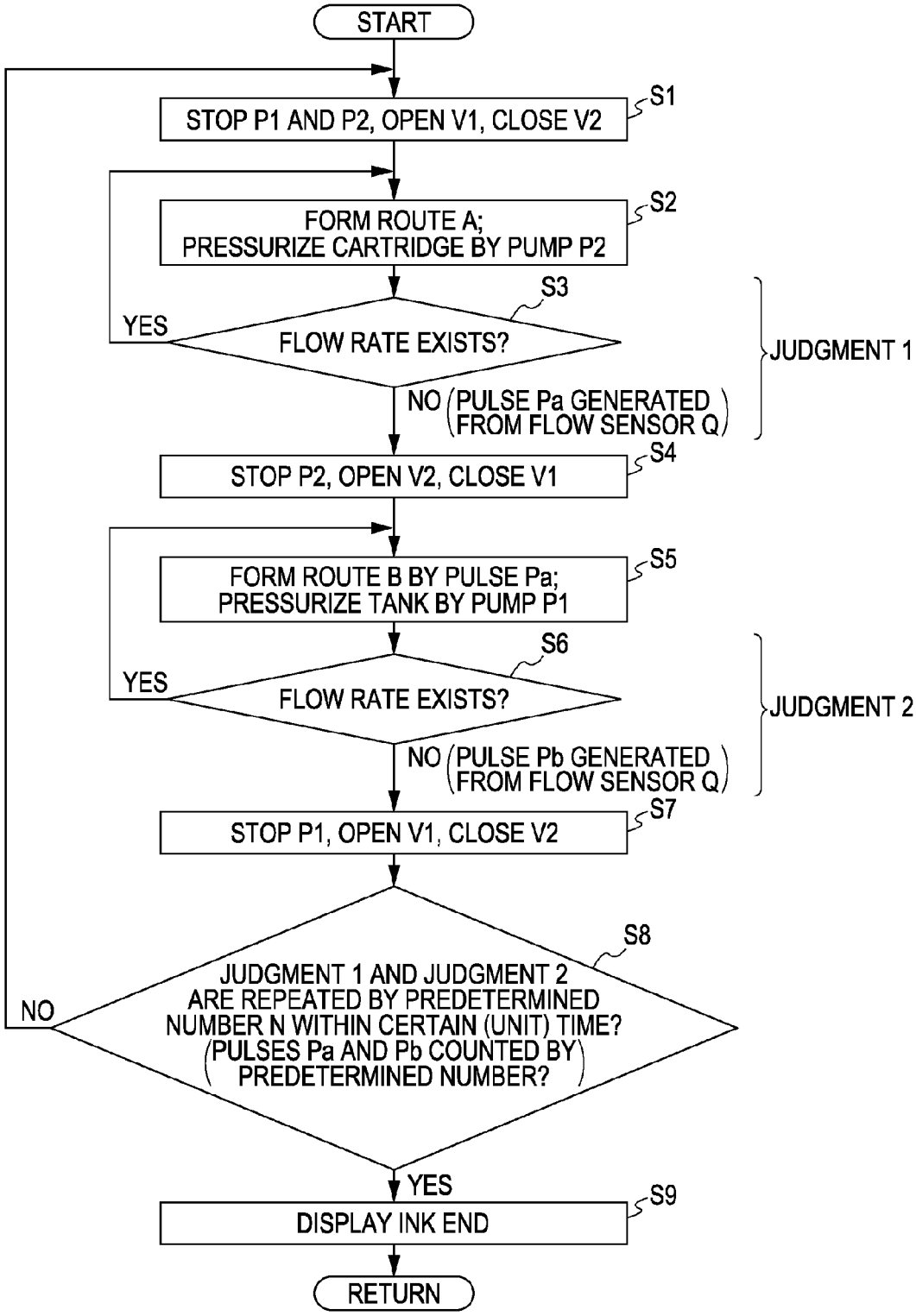
FIG. 3 is a flowchart explaining the control operation of reciprocal replenishment according to the first embodiment of the invention.
Figure 4:
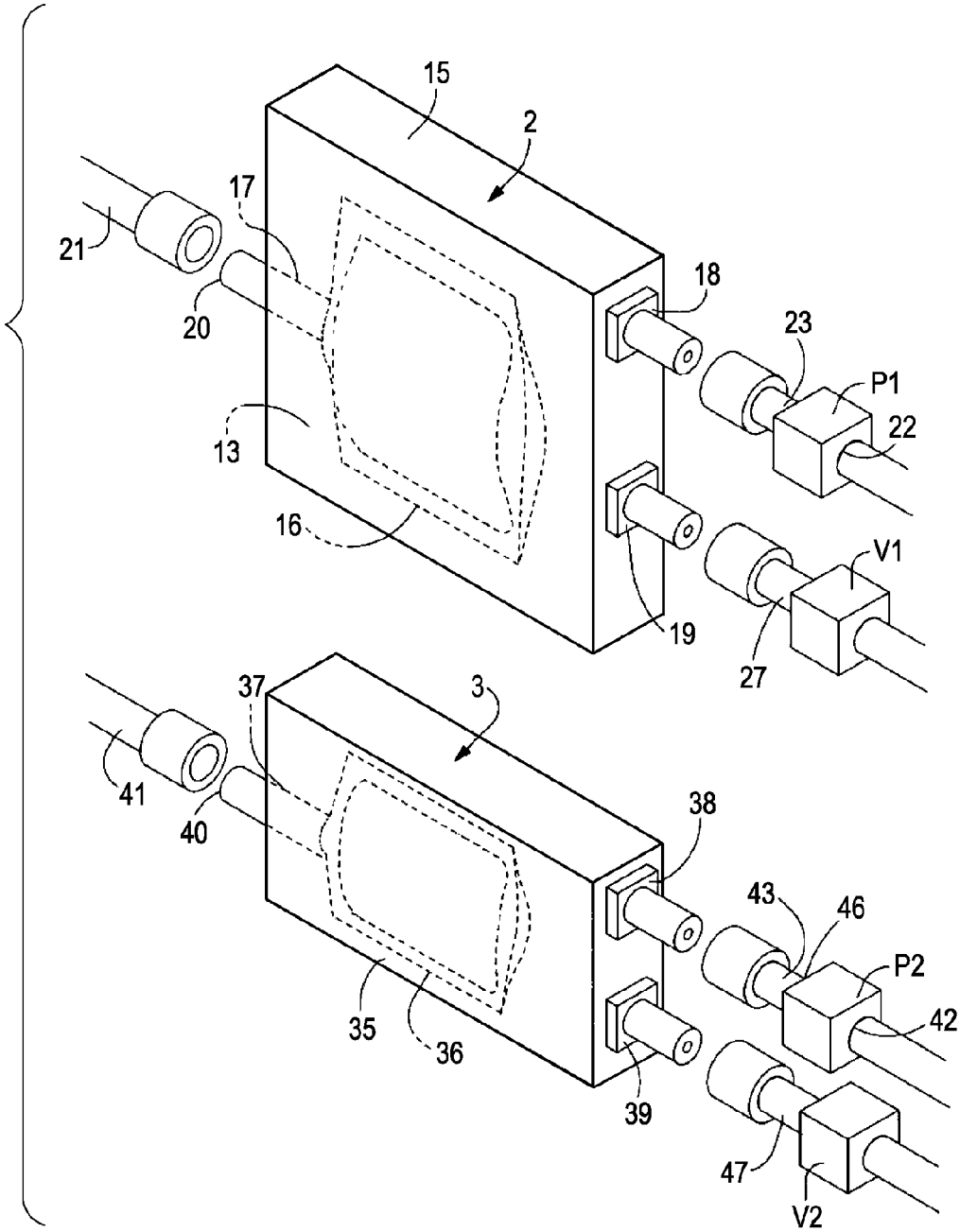
FIG. 4 is a perspective view of an ink tank and an ink cartridge according to the first embodiment of the invention.
Figure 5:
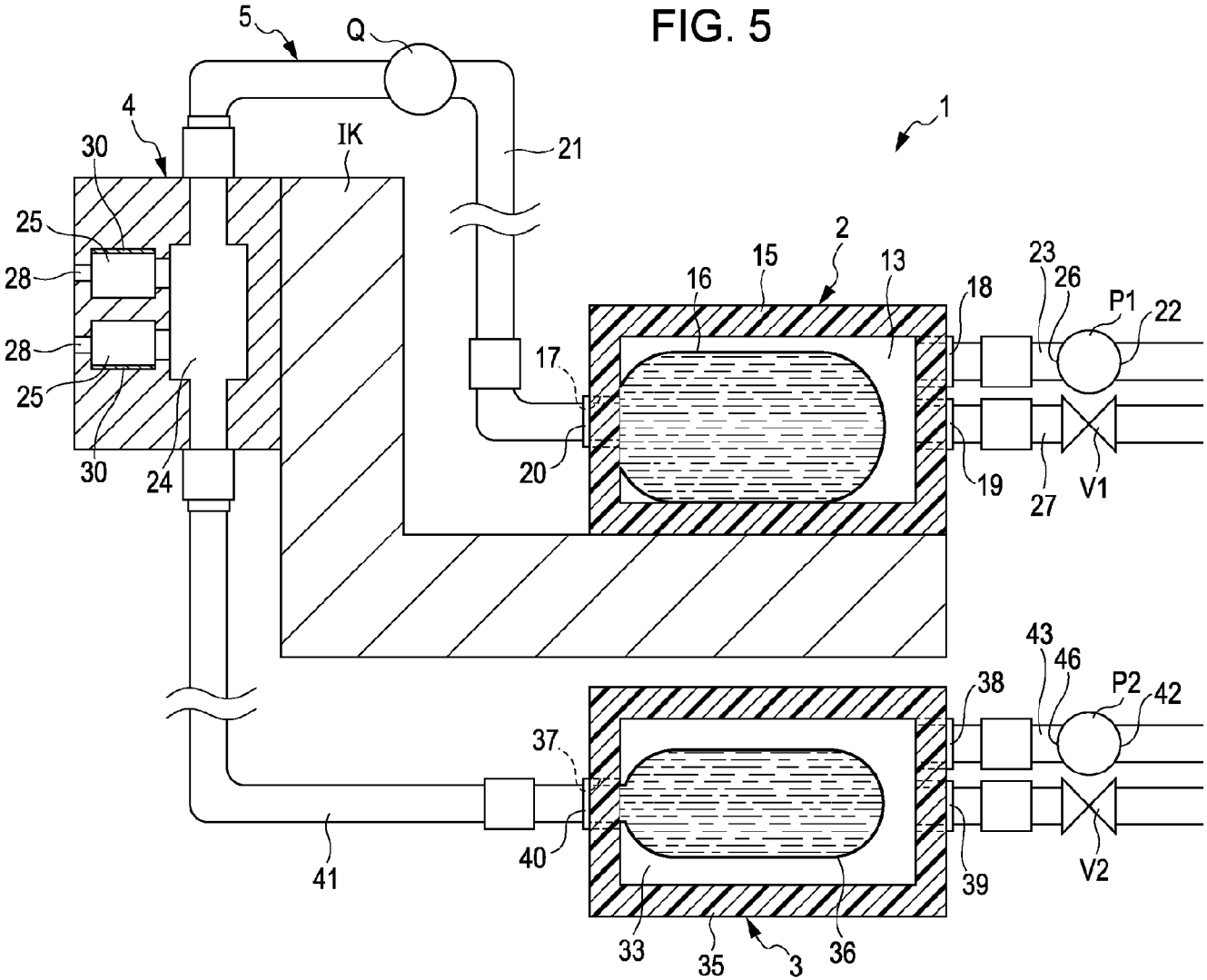
FIG. 5 is a cross-sectional view showing an ink tank, an ink cartridge and a head according to the first embodiment of the invention.

FIGS. 1 to 5 show the first embodiment of the invention. FIG. 1 is a view showing the configuration of a printer device as one example of a liquid ejecting apparatus according to the invention. FIG. 2 is a view showing a fluctuation of an amount IT of ink contained in a tank, a fluctuation of an amount IC of ink contained in a cartridge, a fluctuation of the total amount IK of the ink, and generation timing of a pulse P. FIG. 3 is a flowchart showing the operation of reciprocal replenishing control. FIG. 4 is a perspective view of an ink tank and an ink cartridge. FIG. 5 is a cross-sectional view showing the ink tank, the ink cartridge and a head.

As shown in FIG. 1, the liquid ejecting apparatus, for example, a printer device 1, includes a first liquid containing unit, that is, an ink tank 2 (hereinafter referred to as a tank), for containing ink as a liquid therein, a second liquid containing unit, that is, an ink cartridge 3 (hereinafter referred to as a cartridge) which serves as a storage tank, for containing ink as a liquid therein, a head 4, a communication passage 5 for communicating the tank 2 and the cartridge 3 via the head 4, a pump P1 of the tank 2 side, an open-close valve V1 of the tank 2 side, a pump P2 of the cartridge 3 side, an open-close valve V2 of the cartridge 3 side, a flow sensor Q serving as a detection unit, and a control unit 11.

The tank 2 communicates with the cartridge 3 via the communication passage 5 extending through the head 4, so that a liquid (i.e., ink) is reciprocally (alternatively) supplied to the tank 2 and the cartridge 3 via the communication passage 5. The pump P1 of the tank 2 side serves as a liquid replenishing unit for replenishing the ink to the cartridge 3 from the tank 2 via the communication passage 5. The pump P2 of the cartridge 3 side serves as a liquid replenishing unit for replenishing the ink to the tank 2 from the cartridge 3 via the communication passage 5. In the case where the ink is supplied from any one of the tank 2 and the cartridge 3 to the other via the communication passage 5, the control unit 11 controls in such a way that the ink replenishing side replenishes the ink until the ink filled in the ink replenishing side reaches a specified amount, for example, an empty state or a near empty state, which will be described below.

The tank 2 is fixed or detachably attached to the carriage (head attaching part) IK which is a movable part of the printer device 1. The tank 2 is not replaced with a new one by consumption of the ink in this embodiment, but the tank 2 may be replaced with a new one. As shown in FIGS. 1, 4 and 5, the tank 2 has a containing unit 15 forming a pressure chamber 13, and a storage bag body 16 provided in the pressure chamber 13 and serving as an ink (liquid) containing unit. The containing unit 15 is made of a nonporous hard material such as hard plastic, and is provided with a containing unit-side ink flow port 17 having a bag-side ink flow port 20 which is described below, an air inlet port 18 for communicating an inside of the pressure chamber 13 with the exterior, and an air outlet port 19 for communicating the inside of the pressure chamber 13 with the exterior. The storage bag body 16 is formed of a thin-type bag containing the ink therein and having a variable volume, the bag made of a flexible material having gas permeability substantially equal to or higher than that of the material forming the containing unit 15, such as butyl rubber, polysulfide rubber, epichlorohydrin rubber, high nitrile rubber, or fluorine-contained rubber. The storage bag body is provided with the bag-side ink flow port 20. The bag-side ink flow port 20 is fixed to the containing unit 15 in such a way as to face the exterior of the containing unit 15 through the containing unit-side ink flow port 17, and an opened end of an ink passage 21 of the tank 2 is connected to the bag-side ink flow port 20 of the storage bag body 16 in order to communicate the ink between the ink passage 21 of the tank 2 side and the storage bag body 16. Also, in order to supply the air into the pressure chamber 13, the other opened end of an air supply passage 23 is connected to the air inlet port 18, and the one opened end of the air supply passage 23 is connected to the outlet port 26 of the pump P1 of the tank 2 side. The intake port 22 of the pump P1 of the tank 2 side is opened to the atmosphere. Also, in order to open the inside of the pressure chamber 13 to the atmosphere or interrupt the inside thereof from the atmosphere, the other opened end of an air discharge passage 27 is connected to the air outlet port 19, and the one opened end of the air discharge passage 27 is connected to the open-close valve V1 of the tank 2 side.

The cartridge 3 is detachably attached to the body of the printer device 1, so that the cartridge is replaced with new one by consumption of the ink in the embodiment. As shown in FIGS. 1, 4 and 5, the cartridge 3 has a containing unit 35 forming a pressure chamber 33 therein, and a storage bag body 36 provided in the pressure chamber 33 and serving as an ink (liquid) containing unit. The containing unit 35 is made of a nonporous hard material such as hard plastic, and is provided with a containing unit-side ink flow port 37 having a bag-side ink flow port 40 which is described below, an air inlet port 38 for communicating an inside of the pressure chamber 33 with the exterior, and an air outlet port 39 for communicating the inside of the pressure chamber 33 with the exterior. The storage bag body 36 is formed of a thin-type bag containing the ink therein and having a variable volume, the bag made of a flexible material having gas permeability substantially equal to or higher than that of the material forming the containing unit 35, such as butyl rubber, polysulfide rubber, epichlorohydrin rubber, high nitrile rubber, or fluorine-contained rubber. The storage bag body 36 is provided with the bag-side ink flow port 40. The bag-side ink flow port 40 is fixed to the containing unit 35 in such a way to face the exterior of the containing unit 35 through the containing unit-side ink flow port 37, and an opened end of an ink passage 41 of the cartridge 3 side is connected to the bag-side ink flow port 40 of the storage bag body 36 in order to communicate the ink between the ink passage 41 of the cartridge 3 side and the storage bag body 36. Also, in order to supply the air into the pressure chamber 33, the other opened end of an air supply passage 43 is connected to the air inlet port 38, and the one opened end of the air supply passage 43 is connected to the outlet port 46 of the pump P2 of the cartridge 3 side. The intake port 42 of the pump P2 of the cartridge 3 side is opened to the atmosphere. Also, in order to open the inside of the pressure chamber 33 to the atmosphere or interrupt the inside thereof from the atmosphere, the other opened end of an air discharge passage 47 is connected to the air outlet port 39, and the one opened end of the air discharge passage 47 is connected to the open-close valve V2 of the cartridge 3 side.

In this embodiment, the tank 2 and the cartridge 3 have a similar configuration, except for the replaceable structure. When the cartridge 3 is not in use, the bag-side ink flow port 40 is sealed by a sealing film (not shown). The one opened end of the ink passage 41 of the cartridge 3 side is provided with an ink supply needle (not shown). In the configuration as described above, in the case where the cartridge 3 is attached to the printer device 1, the ink supply needle breaks the sealing film, so that the ink contained in the storage bag body 36 of the cartridge 3 is supplied to the head 4 via a hollow passage of the ink supply needle and the ink passage 41 of the cartridge 3 side. The ink passage 41 of the cartridge 3 side is provided with an open-close valve (not shown) at a position close to the ink supply needle, so that the open-close valve is closed by the control unit 11 when the cartridge 3 is exchanged. The cartridge 3 may be installed in the carriage IK. If a new cartridge 3 is mounted, a switch (not shown) is pushed to initiate the operation of liquid reciprocal replenishment which is described below.

As shown in FIG. 5, the head 4 has an ink chamber 24, a pressure chamber 25, a nozzle 28 and an actuator 30. One opened end of the ink chamber 24 is connected to the other opened end of the ink passage 21 of the tank 2 side in a communication manner, and the other opened end of the ink chamber 24 is connected to the other opened end of the ink passage 41 of the cartridge 3 side in a communication manner. In other words, the communication passage 5 for communicating the tank 2 with the cartridge 3 via the head 4 is constituted by the ink passage 21 of the tank 2 side for communicating the tank 2 with the ink chamber 24, the ink passage 41 of the cartridge 3 side for communicating the cartridge 3 with the ink chamber 24, and the ink chamber 24 serving as an ink passage for communicating the ink passage 21 of the tank 2 side with the ink passage 41 of the cartridge 3 side. One opened end of the pressure chamber 25 communicates with the ink chamber 24, and the other opened end of the pressure chamber 25 communicates with the nozzle 28. The actuator 30 is formed by, for example, a piezoelectric device or heater device which is provided on a wall of the pressure chamber 25.

In the head 4, the ink supplied from the ink chamber 24 to the pressure chamber 25 forms a recessed surface (meniscus) of the ink at an exit of the nozzle 28, and the ink is pushed out from the nozzle 28 by operation of the actuator 30 to form a drop. The drop is adhered to an object to be printed on to carry out the printing with respect to the object to be printed on, such as paper.

The flow sensor Q is provided in the ink passage 21 of the tank 2 as the communication passage 5, and detects that an amount of the ink flowing through the ink passage 21 of the tank 2 side becomes zero. The flow sensor Q outputs a pulse P which is described below, and supplies the pulse to the control unit 11. Accordingly, the flow sensor Q constitutes a detecting unit for detecting an empty state of the ink filled in the tank 2 and the cartridge 3. The amount IT of ink filled in the tank 2 or the amount IC of ink filled in the cartridge 3 is reciprocally varied, as shown in FIG. 2, to become an empty state. Then, if the ink remains in the communication passage 5 (ink passage) of a forward path route A or a return path route B, and the head 4, the flow of ink stops. For this reason, the flow sensor Q detects an amount of the ink flowing through the ink passage 21 of the tank 2 side as zero, and outputs the pulse P (pulse Pa and pulse Pb) indicating that the ink supplied to the tank 2 or the cartridge 3 becomes an empty state, to the control unit 11. In the case where the cartridge 3 replenishes the tank 2 with the ink at the forward path route A, the pulse Pa is output from the flow sensor Q at the time where the amount IC of the ink filled in the cartridge 3 becomes an empty state and the tank is not replenished with the ink. Meanwhile, in the case where the tank 2 replenishes the cartridge 3 with the ink at the return path route B, the pulse Pb is output from the flow sensor Q at the time where the amount IT of the ink filled in the tank 2 becomes an empty state and the cartridge is not replenished with the ink. The flow sensor Q is constituted by a bidirectional flow detector, and has a pulse circuit for outputting the pulse P (i.e., the pulse Pa and the pulse Pb) if the amount IT of the ink filled in the tank 2 or the amount IC of the ink filled in the cartridge 3 becomes an empty state. As shown in FIG. 2, if a remaining amount X of the ink becomes zero at the time tm, the pulse P is not output.

The control unit 11 has a pulse detecting unit 54 for reciprocally detecting the pulse P (i.e., the pulse Pa and the pulse Pb) output from the flow sensor Q, and reciprocally drives a forward path replenishment control unit 51 and a return path replenishment control unit 52 based on the output from the pulse detecting unit 54 to reciprocally set the replenishment route to the forward path route A or the return path route B. The control unit 11 outputs the control signal to a driver 50 for the pumps P1 and P2 or a driver 58 for the open-close valves V1 and V2 via an input/output interface 45. Each of the drivers 50 and 58 controls the pumps P1 and P2 and the open-close valves V1 and V2 based on the control signal output from the control unit to form the forward path route A and the return path route B.

As shown in FIGS. 1 and 2, if the pulse P (i.e., pulse Pb) is output from the flow sensor Q, the forward path replenishment control unit 51 is driven by the reciprocal replenishment control unit 53, so that the return path route B is converted into the forward path route A. Then, the cartridge 3 replenishes the tank 2 with the ink by transferring the ink from the cartridge 3 to the tank 2 via the communication path 5 based on the forward path route A. After that, the pulse P (i.e., the pulse Pa) is output from the flow sensor Q at the time when the amount IC of the ink is in the empty state at the forward path route A. Then, the return path replenishment control unit 52 is driven by the reciprocal replenishment control unit 53, so that the forward path route A is converted into the return path route B. Then, the tank 2 replenishes the cartridge 3 with the ink by transferring the ink from the tank 2 to the cartridge 3 via the communication passage 5 based on the return path route B. In other words, the control unit 11 reciprocally receives the pulses Pa and Pb to enable the reciprocal replenishment control unit 53 to control reciprocally the reciprocal replenishment between the forward path replenishment control unit 51 and the return path replenishment control unit 52. Therefore, the forward path route A and the return path route B are reciprocally formed, and the ink is reciprocated more than once between the cartridge 3 and the tank 2, so that the ink is agitated to prevent precipitate or adhesion of the ink. Further, the concentration of the ink can be properly maintained to prevent sedimentation of the color component of the ink.

The operation of the control unit 11 will now be described in detail. As shown in FIG. 2, whenever the amounts IT and IC of the ink filled in the tank 2 and the cartridge 3 become zero, that is, an empty state, the pulse P (i.e., the pulse Pa and the pulse Pb) is reciprocally output from the flow sensor Q to the control unit. More specifically, when the ink flows from the cartridge 3 to the tank 2 via the forward path route A, if the amount IC of the ink becomes zero, the flow amount of the ink is zero, and the pulse Pa is output from the flow sensor Q. On the contrary, when the ink flows from the tank 2 to the cartridge 3 via the return path route B, if the amount IT of the ink becomes zero, the flow amount of the ink is zero, and the pulse Pb is output from the flow sensor Q. If the pulse detecting unit 54 of the control unit 11 input the pulse Pa, the control of the forward path replenishment control unit 51 is converted into the control of the return path replenishment control unit 52 to form the return path route B. Meanwhile, if the pulse detecting unit 54 input the pulse Pb, the control of the return path replenishment control unit 52 is converted into the control of the forward path replenishment control unit 51 to form the forward path route A. Therefore, the control of reciprocal replenishment is performed to repeat reciprocally the control of the forward path replenishment by the forward path route A and the control of the return path replenishment by the return path route B. Whenever the control unit 11 input the pulse Pa from the flow sensor Q, the control unit 11 determines that the amount IC of the ink filled in the cartridge 3 becomes an empty state, and starts to control the return path replenishment by the return path route B, in which the tank 2 replenishes the cartridge 3 with the ink. Further, whenever the control unit 11 input the pulse Pb from the flow sensor Q, the control unit 11 determines that the amount of the ink filled in the tank 2 becomes an empty state, and starts to control the forward path replenishment by the forward path route A, in which the cartridge 3 replenishes the tank 2 with the ink. Since the control unit 11 reciprocally transfers the ink from the cartridge 3 to the tank 2 or from the tank 2 to the cartridge 3 by the control of replenishment, reciprocal flowage lead to an agitation effect, thereby preventing precipitate or adhesion of the ink and thus properly maintaining the concentration of the ink.

The control operation of reciprocal replenishment will be described with reference to a flowchart shown in FIG. 3. The printer device 1 has the tank 2 of a near empty state in the state of a new product (i.e., an initial use state). The cartridge 3 filled with the ink is mounted in the printer device to form the forward path route A, so that the tank 2 is replenished with the ink via the forward path route A. After that, the control of reciprocal replenishment is initiated according to the flowchart shown in FIG. 3. The control of reciprocal replenishment is performed at the same time as the control of printing operation after the control unit 11 input a printing command.

First of all, at step S1, in the state where the pump P1 of the tank 2 side and the pump P2 of the cartridge 3 side stop, the open-close valve V1 of the tank 2 side is opened to open the pressure chamber 13 of the tank 2 side to the atmosphere. At the same time, the open-close valve V2 of the cartridge 3 side is closed to interrupt the pressure chamber 33 of the cartridge 3 side from the atmosphere, so that the pressure chamber 33 of the cartridge 3 side is maintained in a closed state. At step S2, the pump P2 of the cartridge 3 side is driven to pressurize the inside of the pressure chamber 33 of the cartridge 3 side. Therefore, the forward path route A is formed, and the storage bag body 36 of the cartridge 3 is pressurized by the pressure in the inside of the pressure chamber 33 of the cartridge 3 side, so that the ink filled in the storage bag body 36 of the cartridge 3 is fed to the communication passage 5 and then is moved to the head 4 and the storage bag body 16 of the tank 2. In other words, the control is performed by the forward path replenishment control unit 51 for feeding the ink through the above-described forward path route A. In the replenishment control of the forward path route A, at step S3, in the case where a amount of the ink flowing through the ink passage 21 of the tank 2 side is detected (Yes at step S3), the control unit 11 judges that the amount of the ink in the storage bag body 36 of the cartridge 3 (referred to as an amount IC of ink in the cartridge) is not an empty state, and continuously drives the pump P2 of the cartridge 3 side. The control of the forward path replenishment in the forward path route A is continued by continuously pressurizing the inside of the pressure chamber 33 of the cartridge 3 side (step S2). At step S3, if the amount IC of the ink filled in the cartridge becomes an empty state and the flow amount of the ink is zero, the pulse Pa is output from the flow sensor Q. In the case where the pulse detecting unit 54 detects the pulse Pa (No at step S3), the control unit 11 judges that the amount IC of the ink filled in the cartridge has been an empty state as a predetermined amount (that is, the pulse Pa is generated), and stops the pump P2 of the cartridge 3 side. At the same time, the control unit 11 opens the open-close valve V2 of the cartridge 3 side to open the pressure chamber 33 of the cartridge 3 side to the atmosphere. At the same time, the control unit 11 closes the open-close valve V1 of the tank 2 side to interrupt the pressure chamber 13 of the tank 2 side from the atmosphere, so that the pressure chamber 13 of the tank 2 side is maintained in a closed state (Step S4) to complete the control of the forward path replenishment in the forward path route A. At step S5, the return path route B is formed by the pulse Pa, and the pump P1 of the tank 2 side is driven to pressurize the inside of the pressure chamber 13 of the tank 2 side. In other words, the control of the return path replenishment in the return path route B starts. At step S6, in the case where a flow amount of the ink flowing through the ink passage 21 of the tank 2 side is detected, that is, in the case where the pulse Pb is not input from the flow sensor Q (Yes at step S6), the control unit 11 judges that the amount of the ink in the storage bag body 36 of the tank 2 (referred to as an amount IT of ink in the tank) is not an empty state, and continuously drives the pump P1 of the tank 2 side. The control of the return path replenishment is continued by continuously pressurizing the inside of the pressure chamber 13 of the tank 2 side (step S5). At step S6, if the amount IT of the ink filled in the tank becomes an empty state and the flow amount of the ink is zero, the flow sensor Q outputs the pulse Pb. In the case where the pulse detecting unit 54 detects the pulse Pb (No at step S6), the control unit 11 judges that the amount IT of the ink filled in the tank becomes an empty state, and stops the pump P1 of the tank 2 side at step S7. At the same time, the control unit 11 opens the open-close valve V1 of the tank 2 side to open the pressure chamber 13 of the tank side to the atmosphere. Also, the control unit 11 closes the open-close valve V2 of the cartridge 3 side to interrupt the pressure chamber 33 of the cartridge 3 side from the atmosphere. Therefore, the pressure chamber 33 is maintained in a closed state, and the control of the return path replenishment in the return path route B is completed. As a result, the control of the forward path replenishment in the forward path route A and the control of the return path replenishment in the return path route B are reciprocally performed based on the pulse P (i.e., the pulse Pa and the pulse Pb) output from the flow sensor Q. If the ink is supplied to the ink chamber 24 of the head 4 and then is consumed for printing while the control of the reciprocal replenishment is performed, a time interval T during the empty state is shortened, so that the judgment 1 (No at step S3) and the judgment 2 (No at step S6) become gradually faster. As a result, the number of the pulses P (i.e., the pulse Pa and the pulse Pb) generated every unit time F is increased, and the total amount IK of the amount IC of the ink filled in the cartridge and the amount IT of the ink filled in the tank shown in FIG. 2 is decreased to the extent requiring exchange of the cartridge 3 in accordance with the number of generated pulse. For this reason, at step S8, it is judged whether or not the judgment 1 and the judgment 2 are repeated by the predetermined number N within a certain (unit) time F, that is, whether or not the input number of the pulse Pa and the pulse Pb reaches the predetermined number set in advance within the unit time F. At step S8, in the case where the pulse P reaches the predetermined number N within the unit time (predetermined number) within the unit time, an ink end indicator 57 performs an ink end display (step S9), and instructs the exchange of ink. After the lapse of time tm, if there is no remaining amount X of the ink, the control of the reciprocal replenishment by the control unit 11 stops because the pulse P is not output from the flow sensor Q.

As described above, since the control of the reciprocal replenishment and the control of the printing operation are simultaneously performed, and a part of the ink is fed to the ink chamber 24 of the head 4 via the communication passage 5 and is consumed for the printing, as the control of the reciprocal replenishment proceeds, as shown in FIG. 2, the total amount IK of the amount IC of the ink filled in the cartridge and the amount IT of the ink filled in the tank (the amount of ink exists in the communication passage and the head, but is neglected herein for the sake of convenience) is decreased. The remaining amount X of the ink (i.e., the total amount IK of the ink) is judged at step S8, and since the ink end display has been previously performed before the ink runs down, the necessity for the exchange of the cartridge 3 is urged.

In this instance, it is set in such a way that if there is no remaining amount X of the ink at the time tm, the pulse P is not output from the flow sensor Q, and the operation of the printer device 1 is stopped.

According to the first embodiment, since the ink reciprocates between the ink containing unit (i.e., the tank 2) and the ink containing unit (i.e., the cartridge 3), it is possible to prevent sedimentation or adhesion of the ink and thus properly maintain the concentration of the ink. Also, since the ink contained in the ink containing unit at the side of replenishing the ink is fully squeezed to the empty state, the agitation effect of the ink is increased, and it is possible to prevent effectively sedimentation of the color component of the ink. Also, since the bidirectional flow sensor Q is utilized, it is possible to judge accurately whether or not the ink contained in the ink containing unit at the side of replenishing the ink becomes the empty state, based on the output of one flow sensor Q. Further, since the tank 2 and the cartridge 3 have the pressure chambers 13 and 33 for feeding the ink from the ink containing units to the communication passage 5 at the air pressure output from the pumps P1 and P2, the operation of reciprocal replenishment can be surely performed. Also, since the tank 2 and the cartridge 3 have the ink containing unit possessing flexibility, the operation of reciprocal replenishment can be surely performed. Meanwhile, if the judgment at step S8 can be quickly performed, step S7 may be omitted.

Embodiment 2

In the second embodiment, the idle striking of the ink is prevented by instructing the exchange of the cartridge 3 at the end of the ink replenishment, in the state where the ink remains in the tank 2 at the remaining amount X of the ink. Also, it is possible to prevent the ink from being wastefully thrown away when the cartridge 3 is exchanged.

The ink containable volume of the storage bag body 36 of the cartridge 3 is smaller than that of the storage bag body 16 of the tank 2. Therefore, even though the cartridge 3 replenishes the tank 2 with the total amount of the ink when the cartridge 3 is mounted, it prevents the ink from overflowing the tank 2, and the ink contained in the cartridge 3 is agitated surely. Even though the whole amount of the ink is transferred from the cartridge 3 to the tank 2 after the cartridge 3 is exchanged in the state where the ink remains in the tank 2, there is no overflow of the ink from the tank 2.

Figure 6:
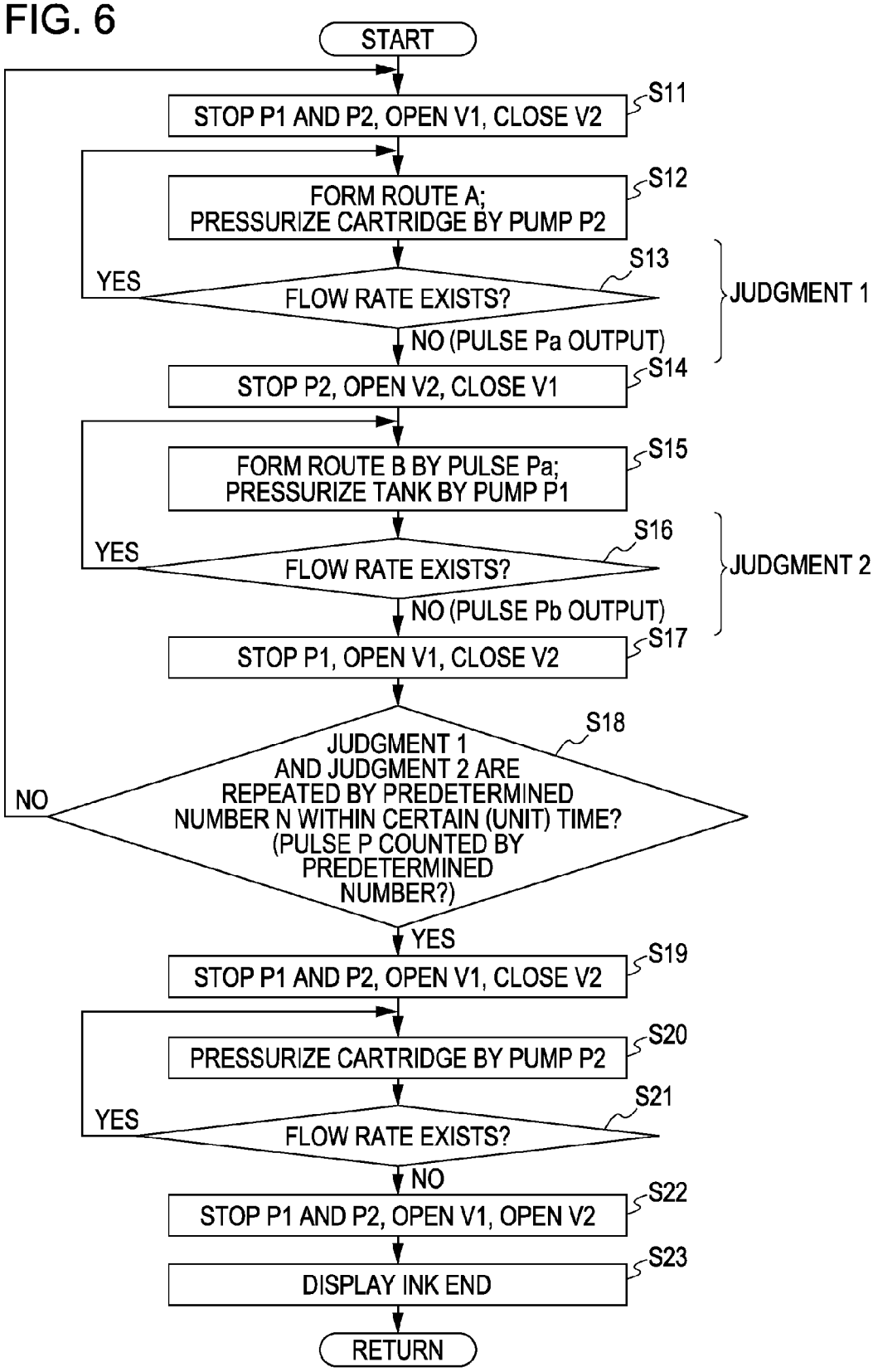
FIG. 6 is a flowchart explaining the control of reciprocal replenishment according to a second embodiment of the invention.

The control of the reciprocal replenishment and the control of the cartridge exchange according to the second embodiment will now be described with reference to FIG. 6. Since the control of reciprocal replenishment at steps S11 to S17 is similar to the control of reciprocal replenishment at steps S1 to S7 according to the first embodiment, the description thereof will be omitted. At step S18, it is judged whether or not the judgment 1 (No at step S13) and the judgment 2 (No at step S16) are repeated by the determined number N every unit time F (hereinafter referred to as exchange judgment). If the judged result at step S18 is Yes, the reciprocal replenishment stops. This corresponds to when the control of the reciprocal replenishment stops when the number of the pulses P (i.e., Pa and Pb) generated every unit time F reaches the predetermined number, and the ink end display may be performed at step S23 in the state where the remaining amount X of the ink remains at a required amount. As the predetermined number N is set high, the remaining amount X of the ink is decreased. Also, as the predetermined number N is set low, the remaining amount X of the ink is increased. Accordingly, in order to increase the remaining amount X of the ink existing in the cartridge 3 when the cartridge 3 is exchanged, the predetermined number N every unit time F may be set low. Also, in order to decrease the remaining amount X of the ink existing in the cartridge 3 when the cartridge 3 is exchanged, the predetermined number N every unit time F may be highly set. In other words, the constant time (unit time) F and the predetermined number N, that is, an exchange judgment value, are determined in accordance with the remaining amount X of the ink existing in the cartridge 3 when the cartridge 3 is exchanged. Also, the exchange judgment value is compensated in accordance with viscosity of the used ink and surrounding temperature. The control unit 11 includes a compensation table to relate the exchange judgment value to the viscosity of the ink, and a compensation table to relate the exchange judgment value to the surrounding temperature. Further, the control unit 11 sets the exchange judgment value by comparing the input viscosity of the ink and the input surrounding temperature with the compensation table. The viscosity of the ink and the surrounding temperature are values input to the control unit 11 via a setting device (not shown) by a user, or values measured by a viscometer (not shown) and a thermometer (not shown) provided in the communication passage 5 and input to the control unit 11.

If the judged result at step S18 is Yes, the control unit 11 judges that the total amount IK of ink has reach the predetermined remaining amount X of the ink set in advance, and stops the operation of the reciprocal replenishment. It proceeds to step S19. At step S19, the control unit 11 stops the driving of the respective pumps P1 and P2, and opens the open-close valve V1 of the tank 2 side to open the pressure chamber 13 of the tank 2 side to the atmosphere. At the same time, the control unit 11 closes the open-close valve V2 of the cartridge 3 side. Next, at step S20, the control unit 11 forms the forward path route A, and drives the pump P2 of the cartridge 3 side to pressurize the inside of the pressure chamber 33 of the cartridge 3 side, so that the whole amount of the ink existing in the cartridge 3 is transferred to the tank 2. In the case where the flow amount of the ink flowing through the ink passage 21 of the tank 2 side is detected at step S21, that is, while the flow sensor Q inputs a certain number other than zero (Yes at step S21), the control unit 11 judges that the amount of the ink filled in the cartridge 3 is not an empty state. The pump P2 of the cartridge 3 side is continuously driven to pressurize continuously the inside of the pressure chamber 33 of the cartridge 3 side (step S20). And then, if the flow amount of the ink flowing through the ink passage 21 of the tank 2 side is zero at the step S21, the control unit 11 cause the flow sensor Q to detect the flow rate of zero (No at step S21). The control unit 11 judges that the amount of the ink filled in the cartridge 3 is an empty state (No at step S21), and stops the driving of the respective pumps P1 and P2 and closes the respective open-close valves V1 and V2 (step S22). Therefore, in the state where all predetermined remaining amounts X of the ink accurately exist in the tank 2, the ink end indicator 57 provided in the body of the printer device 1 performs the ink end display (step S23). The control unit 11 closes an open-close valve (not shown) provided at a position close to the ink supply needle of the ink passage 21 of the cartridge 3 side. After that, the user verifies the ink end display performed by the ink end indicator 57 to operate the exchange of the cartridge 3.

In the second embodiment, the cartridge 3 can be exchanged in the state where the predetermined remaining amount X of the ink accurately exists in the tank 2. Therefore, although the printing operation is carried out, without exchanging the cartridge 3, after the ink end display is performed, the remaining amount of the ink is spent by the head 4 until the predetermined remaining amount Y of the ink is exhausted. As a result, it is possible to prevent the idle striking of the ink in the head 4. Also, since the cartridge 3 is exchanged in the empty state, it is possible to prevent the ink from being wastefully thrown away.

Embodiment 3

Figure 7:
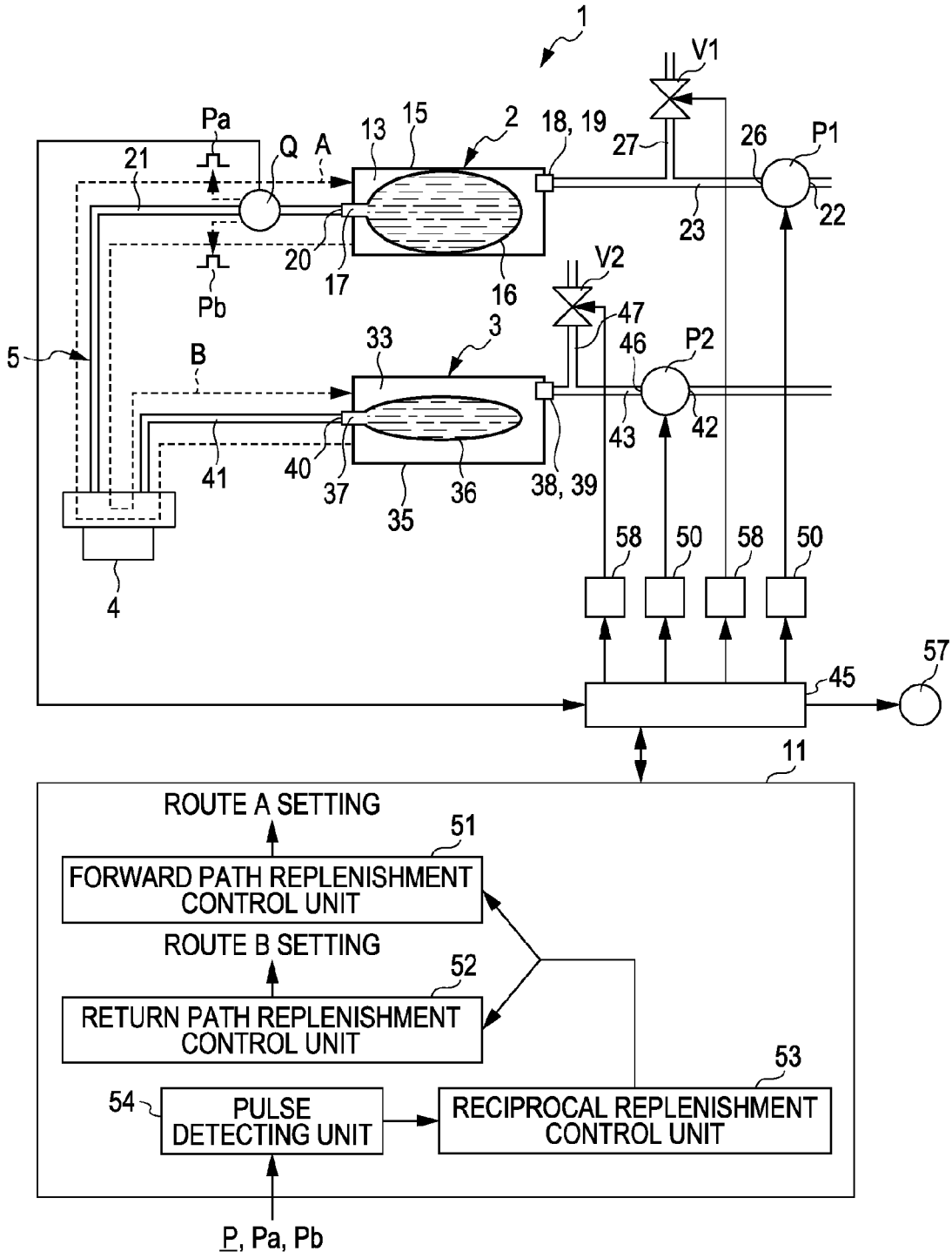
FIG. 7 is a view showing the configuration of a printer device according to a third embodiment of the invention.

As shown in FIG. 7, the air supply passages 23 and 43 may be provided with air exhaust passages 27 and 47, respectively, in such a way that the air supply passages 23 and 43 communicate with the air exhaust passages 27 and 47, and open-close valves V1 and V2 may be installed in the air exhaust passages 27 and 47.

Embodiment 4

Figure 8:
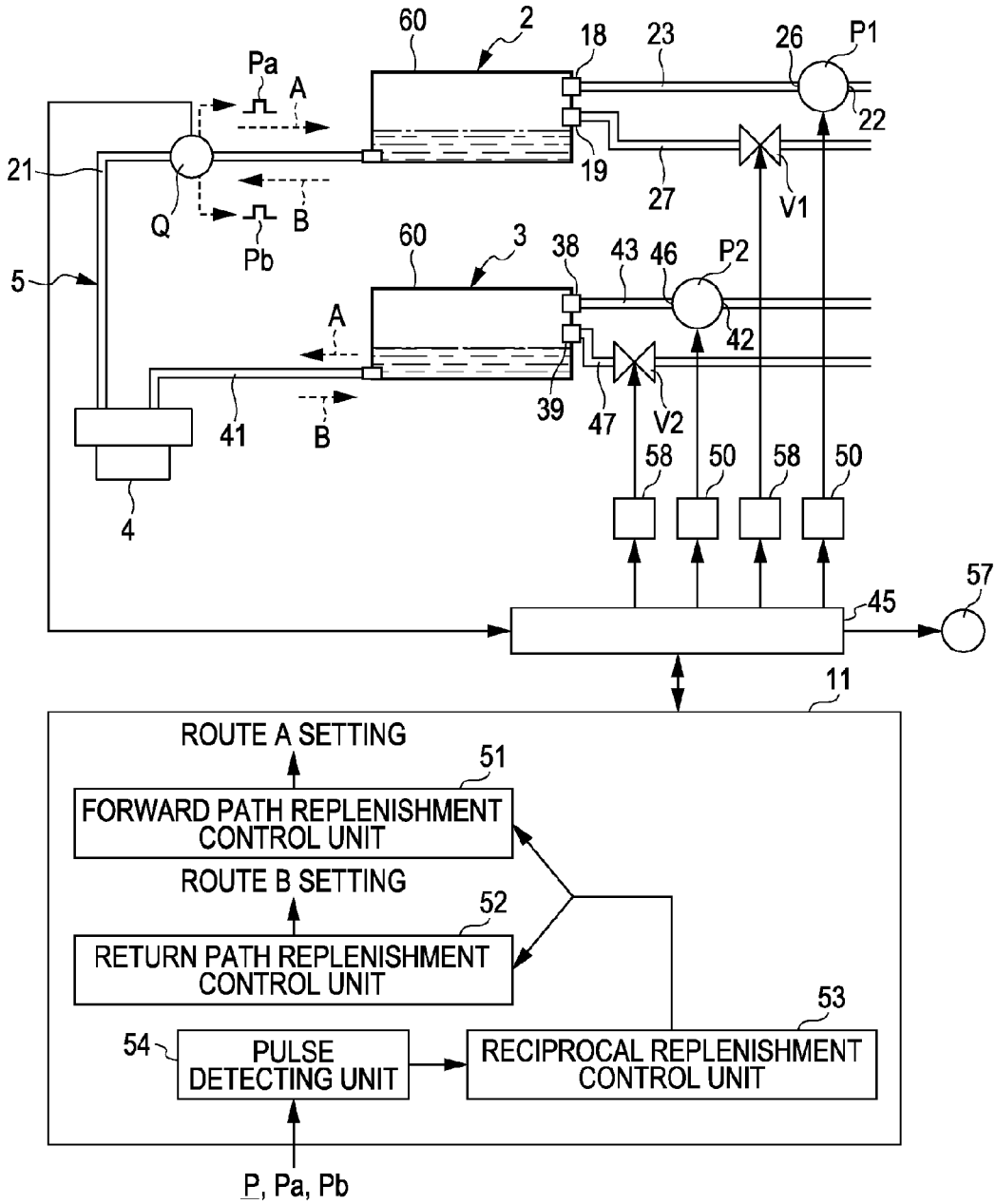
FIG. 8 is a view showing the configuration of a printer device according to a fourth embodiment of the invention.
Figure 9:
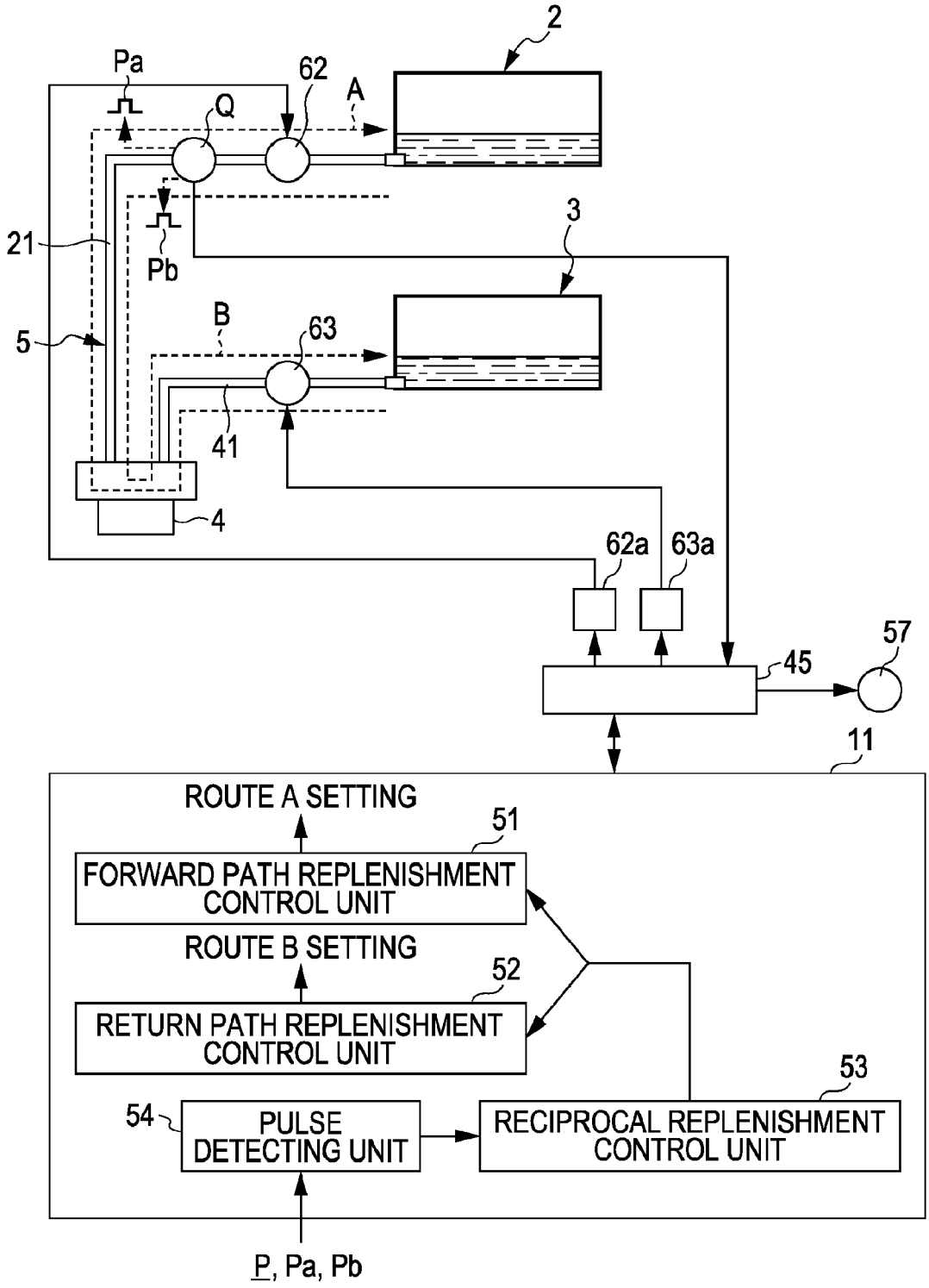
FIG. 9 is a view showing the configuration of the printer device according to the fourth embodiment of the invention.

In the case where the ink is one employing a petroleum solvent, as shown in FIG. 8, the ink containing units of the tank 2 and the cartridge 3 for containing the ink may be formed of a vessel 60 made of a hard material and having a constant ink containing volume. In this instance, as shown in FIG. 8, the control of reciprocal replenishment may be performed by pressing the ink filled in the containing unit 60 using the pressurized air of the press pumps P1 and P2, similar to the configuration according to the first embodiment shown in FIG. 1. In this instance, the ink comes in contact with the air, but the ink can be used if the ink which is not deteriorated by the air is available. Instead of the configuration shown in FIG. 8, similar to the case shown in FIG. 7, the air supply passages 23 and 43 may be provided with air exhaust passages 27 and 47, respectively, in such a way that the air supply passages 23 and 43 communicate with the air exhaust passages 27 and 47, and open-close valves V1 and V2 may be installed in the air exhaust passages 27 and 47, which is not shown in the drawings. As shown in FIG. 9, the communication passage 5 may be provided with suction pumps 62 and 63, and a suction direction of the suction pumps 62 and 63 may be controlled by the control unit 11 via drivers 62*a* and 63*a* to perform the control of reciprocal replenishment.

Embodiment 5

Figure 10:
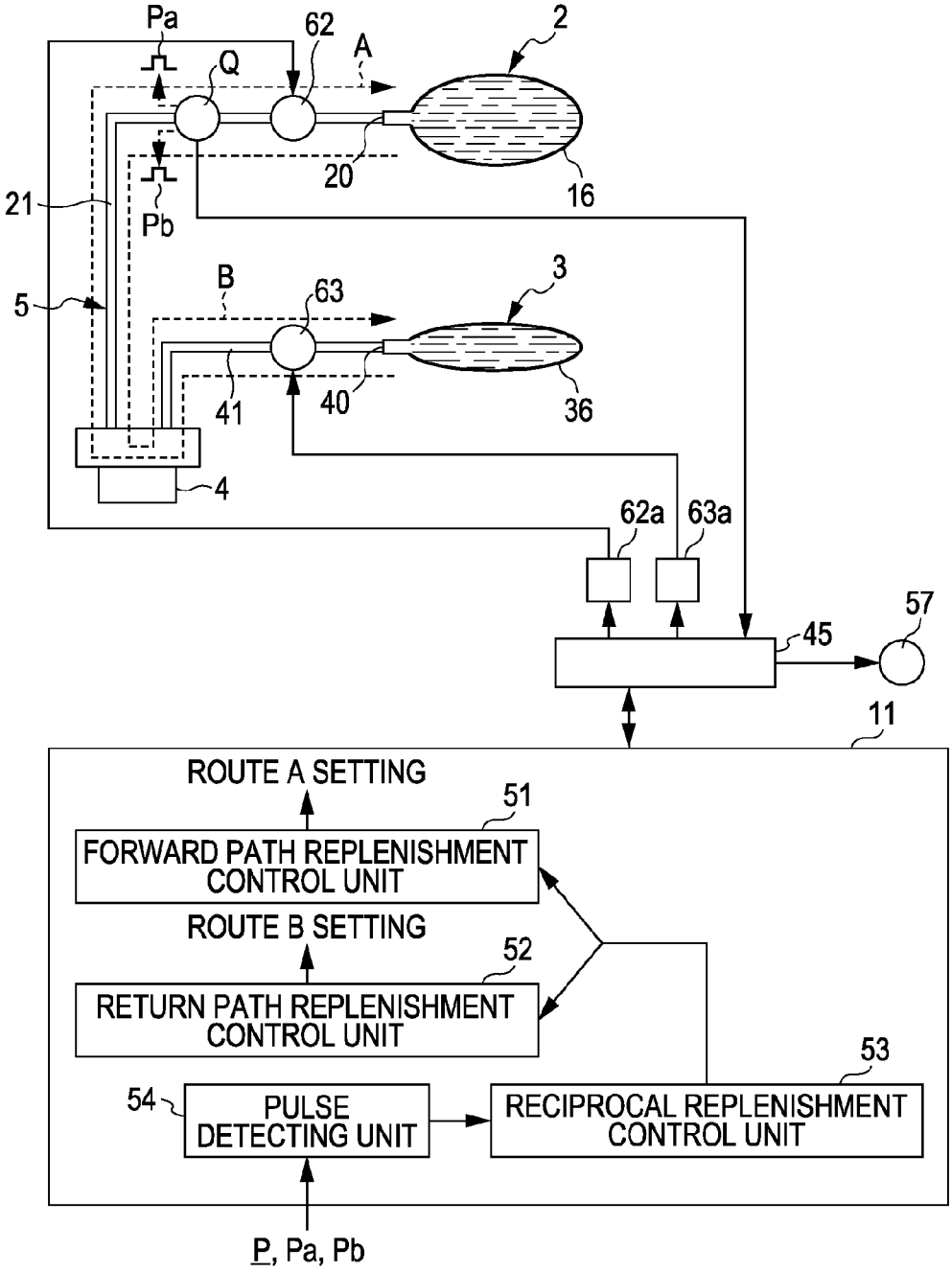
FIG. 10 is a view showing the configuration of a printer device according to a fifth embodiment of the invention.

As shown in FIG. 10, the ink containing unit may be constituted by a bag made of a flexible material having gas impermeability and a variable ink containing volume, and utilize the tank 2 and the cartridge 3 which have no pressure chambers 13 and 33. In this instance, the communication passage 5 is provided with the suction pumps 62 and 63, and a suction direction of the suction pumps 62 and 63 is controlled by the control unit 11 via drivers 62*a* and 63*a* to perform the control of reciprocal replenishment.

Embodiment 6

Figure 11:
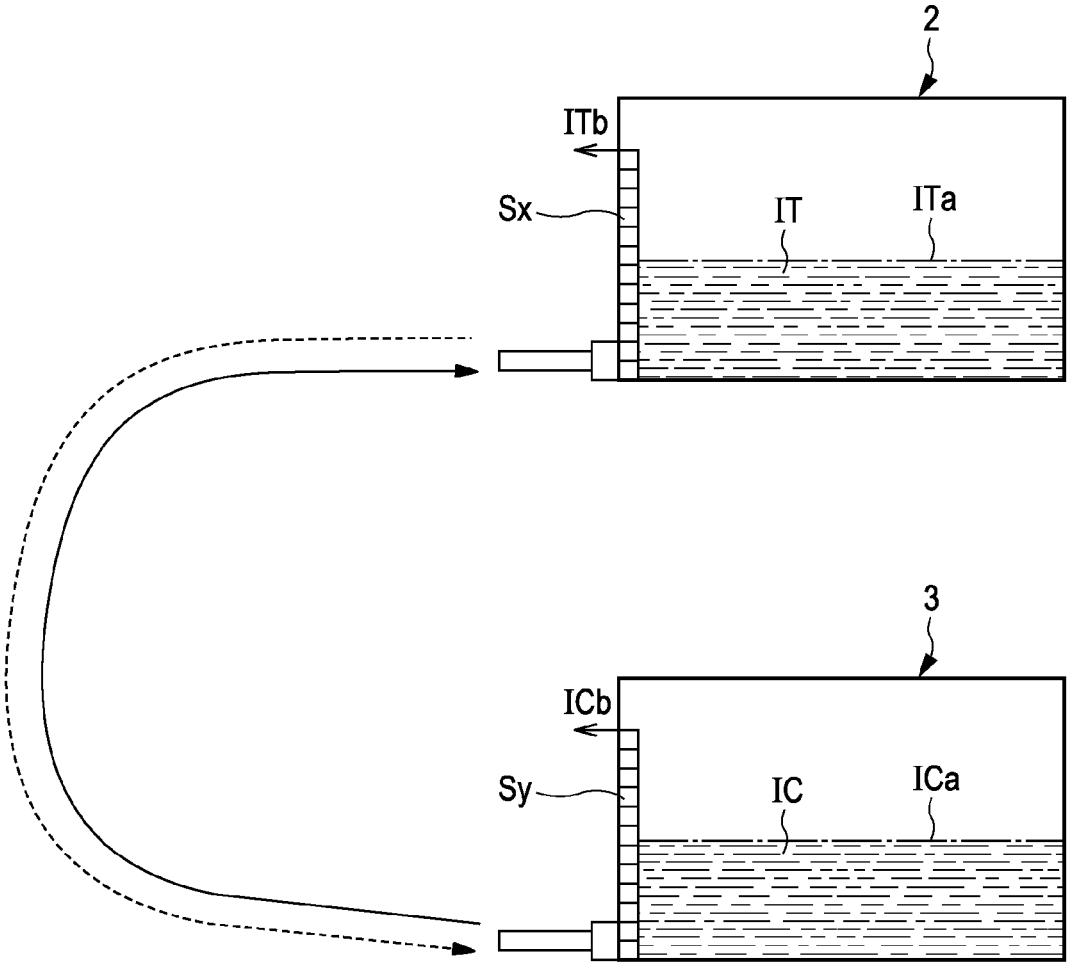
FIG. 11 is a view showing the control of reciprocal replenishment according to a sixth embodiment of the invention.
Figure 12:
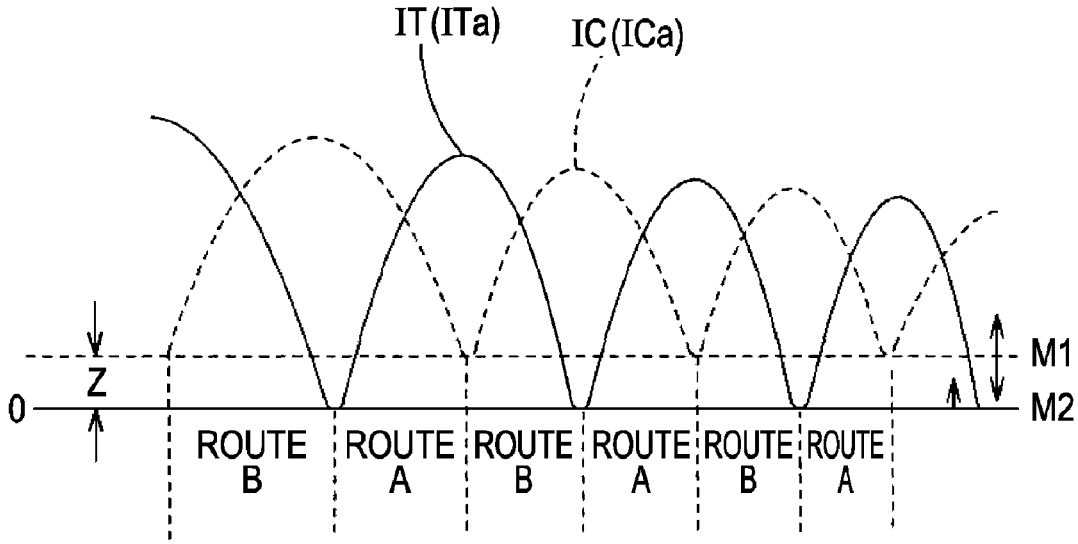
FIG. 12 is a view showing the control of reciprocal replenishment according to the sixth embodiment of the invention.

As shown in FIG. 11, a level sensor may be provided in the ink containing unit of the tank 2 and the ink containing unit of the cartridge 3, respectively, as a detecting unit, to output an analog signal in accordance with a liquid volume of the ink contained in the respective ink containing units. For example, a level sensor Sx for detecting and outputting a liquid level ITa of the ink filled in the ink containing unit of the tank 2 and a level sensor Sy for detecting and outputting a liquid level ICa of the ink filled in the ink containing unit of the cartridge may output analog signals ITb and ICb indicative of the liquid levels, and predetermined values (predetermined amounts) M1 and M2 of adjustable size stored in a memory (not shown) of the control unit 11 may be compared with the analog signals ITb and ICb to control the reciprocal replenishment, as shown in FIG. 12. In other words, whenever the signals ITb and ICb reach the predetermined values (predetermined amounts) M1 and M2, it is possible to control the switching timing of reciprocal replenishment between the forward path route A and the return path route B. It is possible to control the replenishment until the ink filled in the tank 2 and the cartridge 3 reaches a predetermined amount. More specifically, if reference values M1 and M2 are set to zero, the control of the reciprocal replenishment is carried out until both ink filled in the tank 2 and the cartridge 3 becomes an empty state as described in the first embodiment. Also, if the reference values M1 and M2 are set to a certain number other than zero, it is possible to switch the control of forward path replenishment and the control of return path replenishment in the state where the ink remains in any one of the tank 2 and the cartridge 3.

As shown in FIG. 12, in the case where the cartridge 3 replenishes the tank 2 with the ink via the forward path route A, the replenishment can be controlled until the ink filled in the ink containing unit of the cartridge 3 remains in a predetermined amount Z. In the case where the tank 2 replenishes the cartridge 3 with the ink via the return path route B, the replenishment control can be switched into the control of forward path replenishment until the ink filled in the ink containing unit of the tank 2 becomes an empty state. With the above configuration, when the ink is replenished between the tank 2 and the cartridge 3, the ink to be contained in the tank 2 is agitated more surely than the ink to be contained in the cartridge 3. In other words, it is possible to select an ink containing unit which intensively agitates the ink contained in the tank 2 and the cartridge 3, by properly setting the reference value M1 and the reference value M2.

Figure 13:
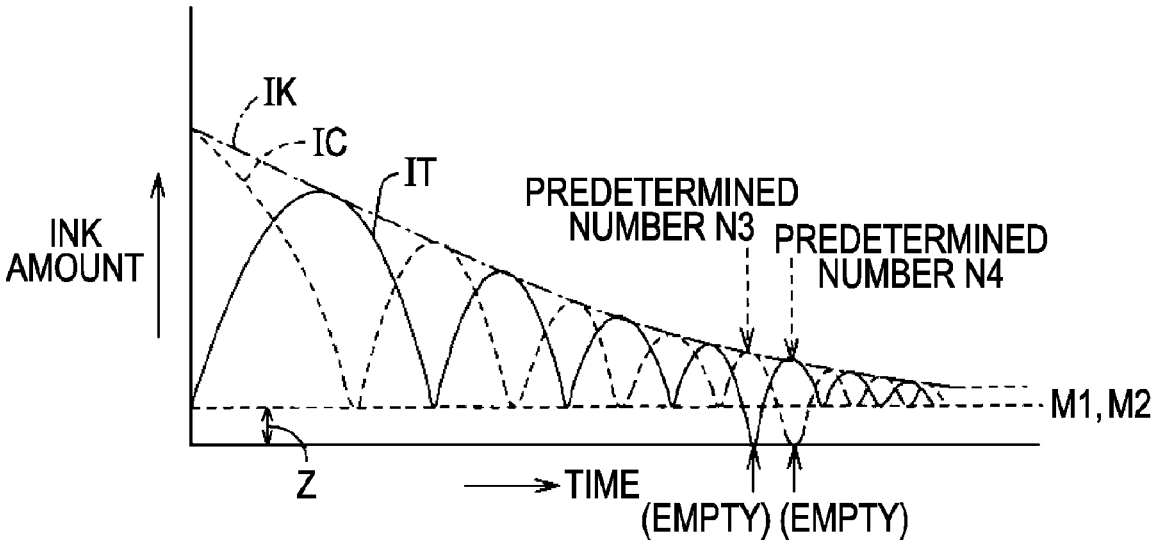
FIG. 13 is a view showing a relation between a fluctuation of an amount of ink and an output of a flow sensor according to the sixth embodiment of the invention.

As shown in FIG. 13, the configuration below may be employed as the control of reciprocal replenishment performed by the control unit 11. In other words, until the number of the control of reciprocal replenishments reaches predetermined numbers N3 and N4, the replenishment control is performed in such a way that amounts of the ink filled in both ink containing units of the tank 2 and the cartridge 3 remain in the predetermined amount Z. Meanwhile, at the time that the number of the control of reciprocal replenishments reaches predetermined numbers N3 and N4, the ink is supplied until the amount of the ink filled in both ink containing units of the tank 2 and the cartridge 3 becomes an empty state. In this instance, it is possible to change the replenishing operation of the ink which is carried out between the tank 2 and the cartridge 3. More specifically, before the number of the control of reciprocal replenishments reaches the predetermined numbers N3 and N4, the amount of the ink remaining in the tank 2 or the cartridge 3 is set high when the replenishment of the ink is operated, rather than the time when the number of the control of reciprocal replenishments reaches the predetermined numbers N3 and N4. Therefore, it is possible to increase the number of the replenishing operations of the ink carried out between the tank 2 and the cartridge 3. Immediately after the cartridge 3 is exchanged and before the number of the control of reciprocal replenishments reaches the predetermined numbers N3 and N4, it is assumed that the total amount of the ink contained in the tank 2 and the cartridge 3 is relatively increased. With the above configuration, it is possible to suppress reduction in the number of the replenishing operation of the ink which is carried out between the tank 2 and the cartridge 3, even in the above instance.

Alternatively, the configuration below may be employed as the control of reciprocal replenishment carried out by the control unit 11. In other words, until time from the start of the control of reciprocal replenishments reaches predetermined times t1 and t2 set in a timer (not shown), the control of replenishment is stopped, with the amount of the ink filled in the ink containing unit supplying the ink being left only by a predetermined amount Z. If it reaches the predetermined times t1 and t2, the ink is replenished until the amount of the ink filled in the ink containing unit supplying the ink becomes an empty state in the control of replenishment at that time. In this instance, the control unit 11 reciprocally replenishes the ink containing units with the ink, and whenever the number of replenishments reaches a predetermined number or the reciprocal replenishments reaches a predetermined time, the replenishment is carried out until the amount of the ink filled in the ink containing unit supplying the ink becomes an empty state. With the above configuration, it is possible to prevent effectively the precipitate or adhesion of the ink, or the sedimentation of the color component of the ink, since the operation of the reciprocal replenishment is varied. Further, since the control of reciprocal replenishment is quickly switched and the head 4 is early supplied with the ink, the invention is effective against the case where the ink consumption of the head 4 is high. Since the level sensors Sx and Sy for outputting analog signals in accordance with the amount of the ink filled in the ink containing unit are used as a detecting unit, the judgment whether or not the ink filled in the ink containing unit supplying the ink is a predetermined amount can be accurately performed by the output of the level sensors.

Embodiment 7

Although there is described above the flow sensor Q for outputting the pulse Pa (at the route A) or the pulse Pb (at the route B) at the time in which the amount of the ink supplied in the tank 2 and the cartridge 3 becomes an empty state and thus the flow amount of the ink is zero; nevertheless a bidirectional flow sensor, which outputs an analog signal to the control unit 11 without pulse-processing the analog signal corresponding to the flow amount of the ink, may be utilized as the flow sensor Q. In the latter instance, the control unit 11 is adapted to compare the analog signal with a predetermined value (a comparative level) and reciprocally control the forward path replenishment control unit 51 and the return path replenishment control unit 52 based on the compared results.

Therefore, if the predetermined value is set to zero, it is possible to switch the forward path route A and the return path route B when the flow amount is zero. Also, by setting the predetermined value to a variable value and setting the ink to a near empty state, it is possible to reciprocally replenish the ink, with a little ink remaining.

Alternatively, by setting the predetermined value of any one of the tank 2 and the cartridge 3 to zero, it is possible to control just one of the tank 2 and the cartridge 3 in an empty state, as shown in FIG. 12.

Embodiment 8

Figure 14:
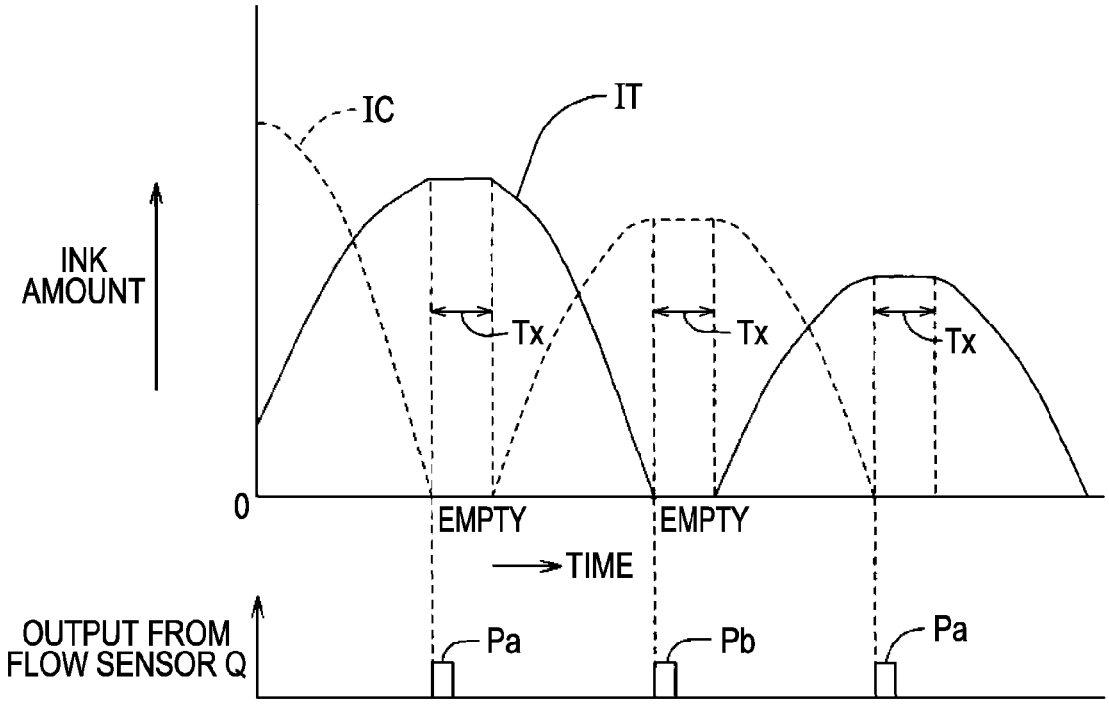
FIG. 14 is a view showing the control of reciprocal replenishment according to an eighth embodiment of the invention.

As shown in FIG. 14, after the flow sensor Q outputs the pulse P, the control unit 11 may be adapted to carry out the replenishing operation during a certain time Tx previously set in a separate timer (not shown), and then control the reciprocal replenishment. In other words, as shown in FIG. 1, in the case where the control unit 11 has such a configuration that only one flow sensor Q is provided in the ink flow passage, at the time the flow sensor Q outputs the pulse P (i.e., the pulse Pa and the pulse Pb) to the control unit 11, the ink with respect to the ink containing unit supplying the ink may not become an empty state. In the eighth embodiment, even after the flow sensor Q outputs the pulse Pa or the pulse Pb to the control unit 11 as the amount of the ink in the forward path route A or the return path route B becomes zero, the control unit 11 receives the pulse Pa or the pulse Pb from the flow sensor Q, and carries out the squeezing operation of the ink with respect to the ink containing unit during a certain time Tx to perform the control of the reciprocal replenishment. With this configuration, since it is possible to improve the squeezing effect of the ink with respect to the ink containing units of the tank 2 and the cartridge 3, so that the ink existing in the ink containing unit of the tank 2 or the cartridge 3 is more surely extruded and agitated to improve the agitating effect of the ink. Also, with the configuration capable of maintaining the empty state of the ink in the ink containing units of the tank 2 and the cartridge 3 during the predetermined time Tx, the ink can be empty-squeezed during the predetermined time Tx, and, as a result, the precipitate of the ink is driven out, and thus the squeezing effect can be expected.

Embodiment 9

Figure 15A:
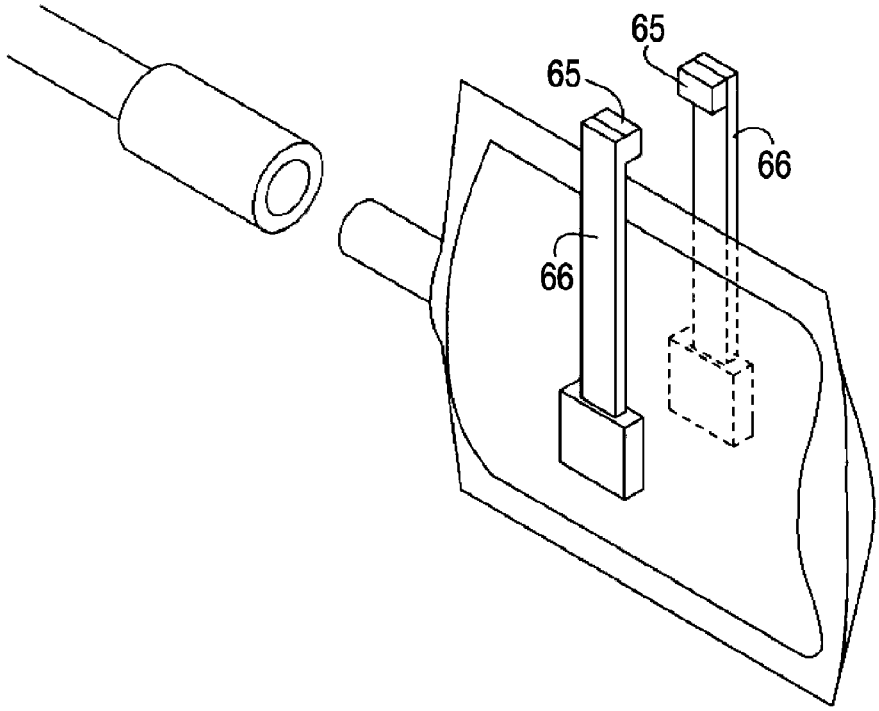
FIG. 15A is a perspective view of an ink tank and an ink cartridge according to a ninth embodiment of the invention.
Figure 15B:
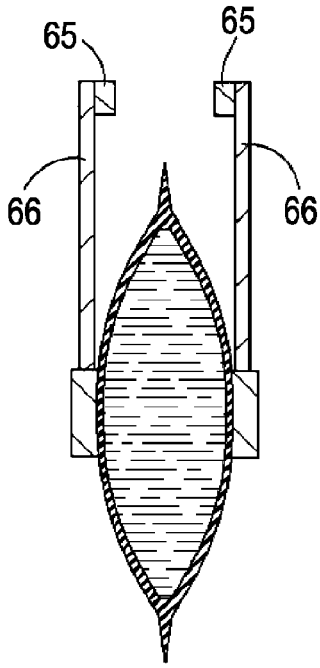
FIGS. 15B and 15C are views showing a detection method of a detection sensor according to the ninth embodiment of the invention.
Figure 15C:
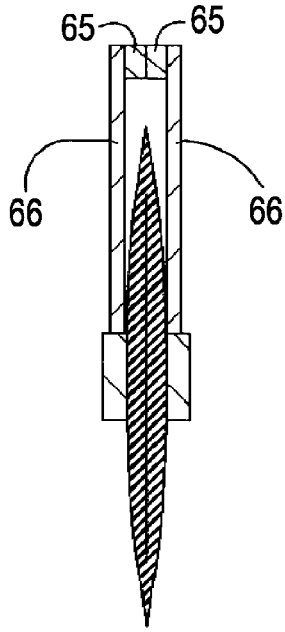
Figure 16:
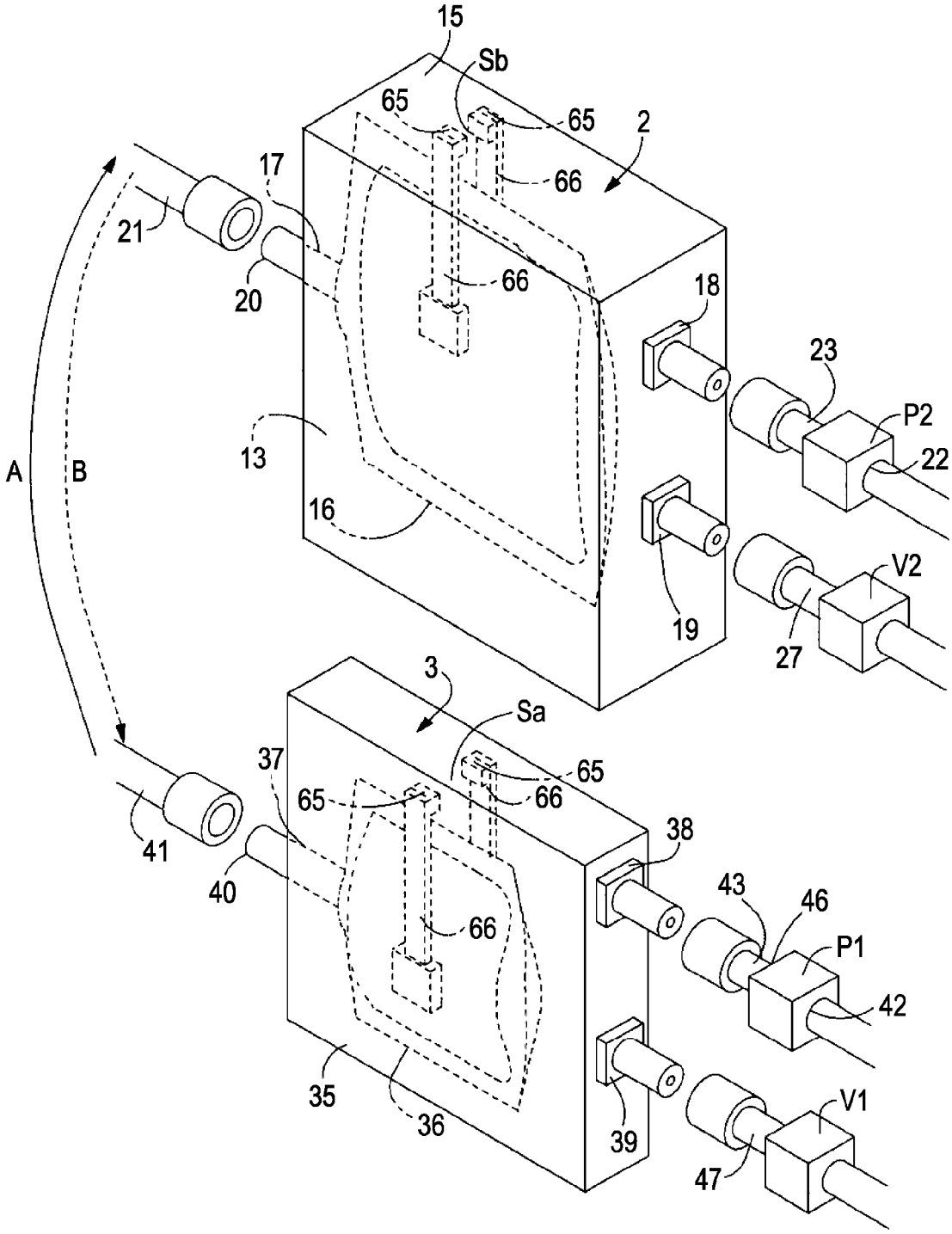
FIG. 16 is a perspective view of an ink tank and an ink cartridge according to the ninth embodiment of the invention.

In the case where a bag made of a flexible material having gas permeability substantially equal to or higher than that of the material forming the containing unit 15 and having a variable ink containing volume is used as the ink containing unit, as shown in FIGS. 15 and 16, a sensor 65 for detecting contact-point contact may be used as the detecting unit for detecting that the ink filled in the ink containing unit supplying the ink becomes an empty state. That is, arms 66 and 66 are respectively attached to outer surfaces of the opposite inner surfaces of the storage bag bodies 16 and 36, and the respective arms 66 and 66 are provided at the front end thereof with the sensors 65 and 65 for detecting contact-point contact. If the opposite inner surfaces come in contact with each other and thus the sensors 65 and 65 for detecting the contact-point contact come in contact with each other, the control unit 11 receives the pulse indicating that the amount of the ink filled in the ink containing unit supplying the ink is a predetermined value. In other words, since the detecting unit is constituted by a sensor for detecting a size variation of the flexible ink containing unit provided in the tank and the cartridge, it can accurately judge whether the ink filled in the ink containing unit supplying the ink becomes an empty state, based on the output of the sensor.

Embodiment 10

Figure 17:
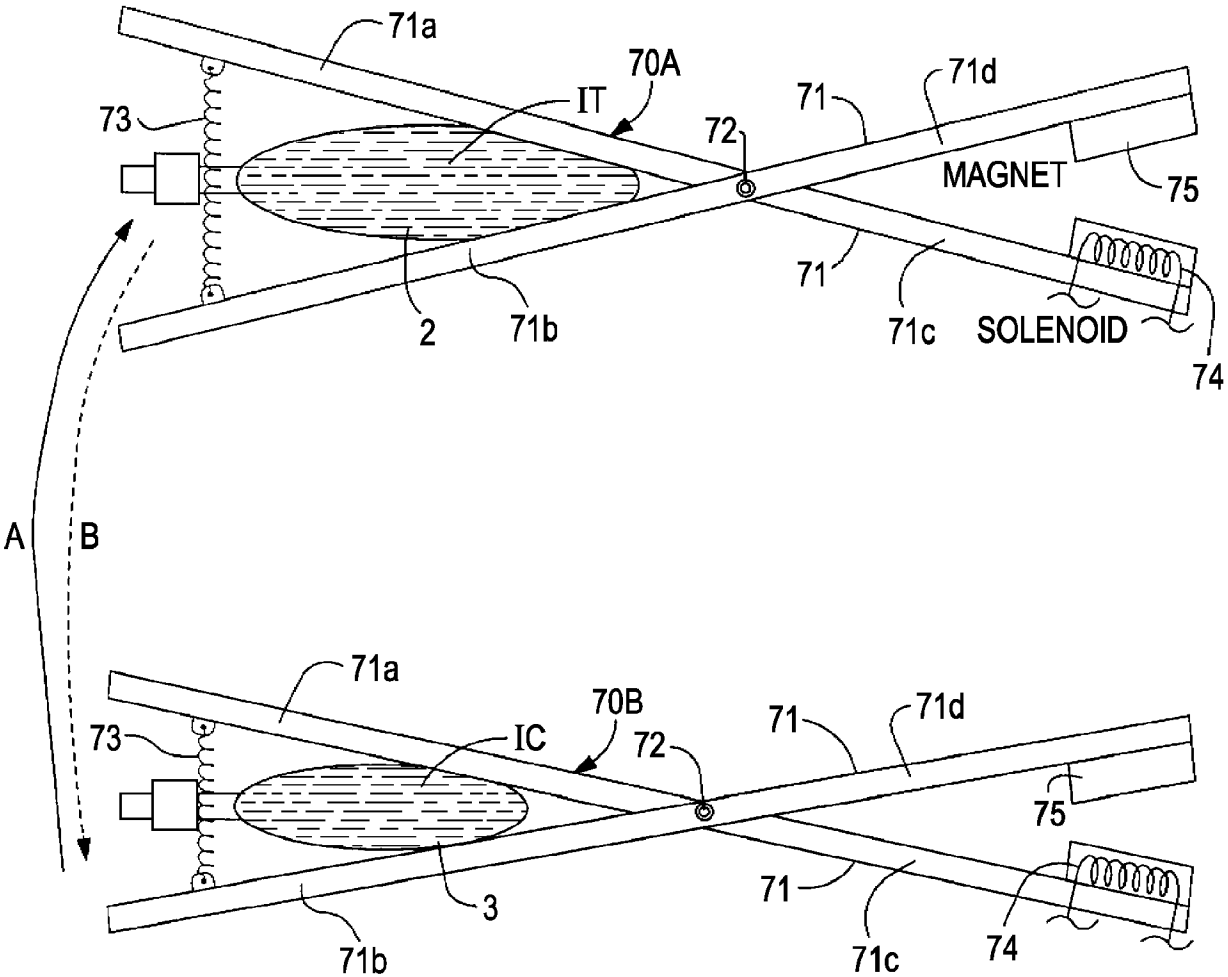
FIG. 17 is a view of a pressing unit according to the tenth embodiment of the invention.

In the case where a bag made of a flexible material having gas impermeability and a variable ink containing volume is used as the ink containing unit, mechanical scissor unit 70A and 70B may be used as a unit for pressurizing the ink containing unit and pushing the ink into the communication passage 5, as shown in FIG. 17. The mechanical scissor unit 70A and 70B include two rods 71 and 71 which can pivot on a rotation shaft 72 in an opposite direction to vary an angle of intersection. Two rods 71 and 71 are connected to each other by a spring 73, with the ink containing units of the tank 2 and the cartridge 3 being interposed between a free end 71*a* and a free end 71*b* opposite to the free end 71*a*. Also, the two rods 71 and 71 include a solenoid 74 provided at the other end 71*c* of one of the two rods facing each other, and a magnet 75 provided at the other end 71*d* of the of the two rods. Therefore, the control unit 11 turns on and off the solenoid 74 of the mechanical scissor unit 70A provided in the tank 2 and the solenoid 74 of the mechanical scissor unit 70B provided in the cartridge 3 to control the reciprocal replenishment using the forward path route A and the return path route B.

Embodiment 11

Figure 18:
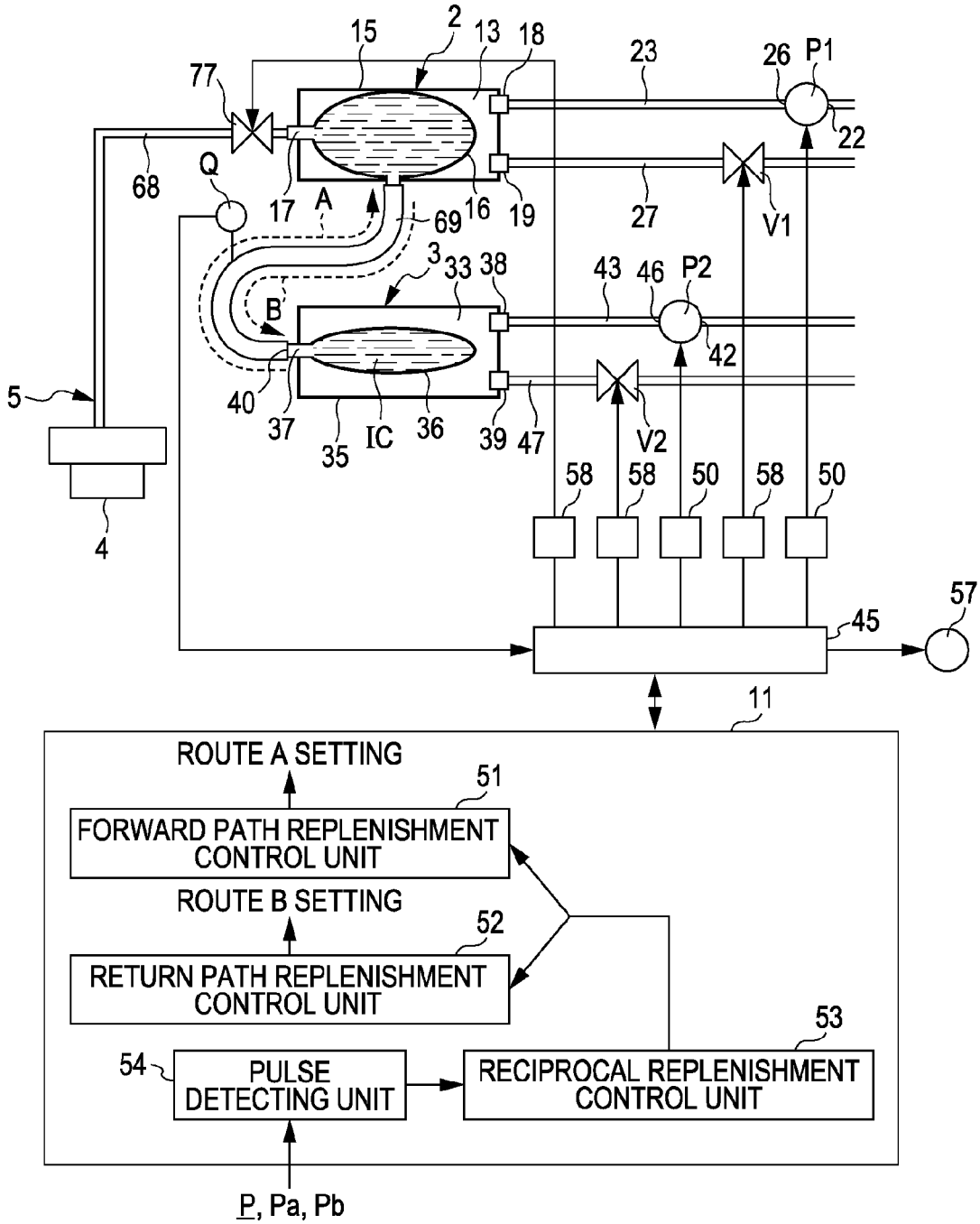
FIG. 18 is a view showing the configuration of a printer device according to an eleventh embodiment of the invention.

As shown in FIG. 18, the head 4 may be provided with an ink supply passage 68 and an ink reciprocating passage 69 respectively. The ink supply passage 68 is provided with an open-close valve 77. In this instance, the control of printing and the control of reciprocal replenishment are separately performed. More specifically, the open-close valve 77 is closed, and the forward path route A and the return path route B are formed between the tank 2 and the cartridge 3 via the ink reciprocating passage 69 to agitate the ink through the control of reciprocal replenishment. After that, the open-close valve 77 is opened, and the pump P1 is driven to feed the air to the pressure chamber 13 of the tank 2 to supply the ink from the ink containing unit to the head 4. In this embodiment, the head 4 can be supplied with the ink, having little condensation unevenness, which is agitated by the ink flowing through the forward path route A and the return path route B to carry out the printing. Also, the distance of the ink reciprocating passage 69 between the tank 2 and the cartridge 3 can be shortened to reciprocate the ink in a short time and improve the agitating effect of the ink.

Embodiment 12

Figure 19:
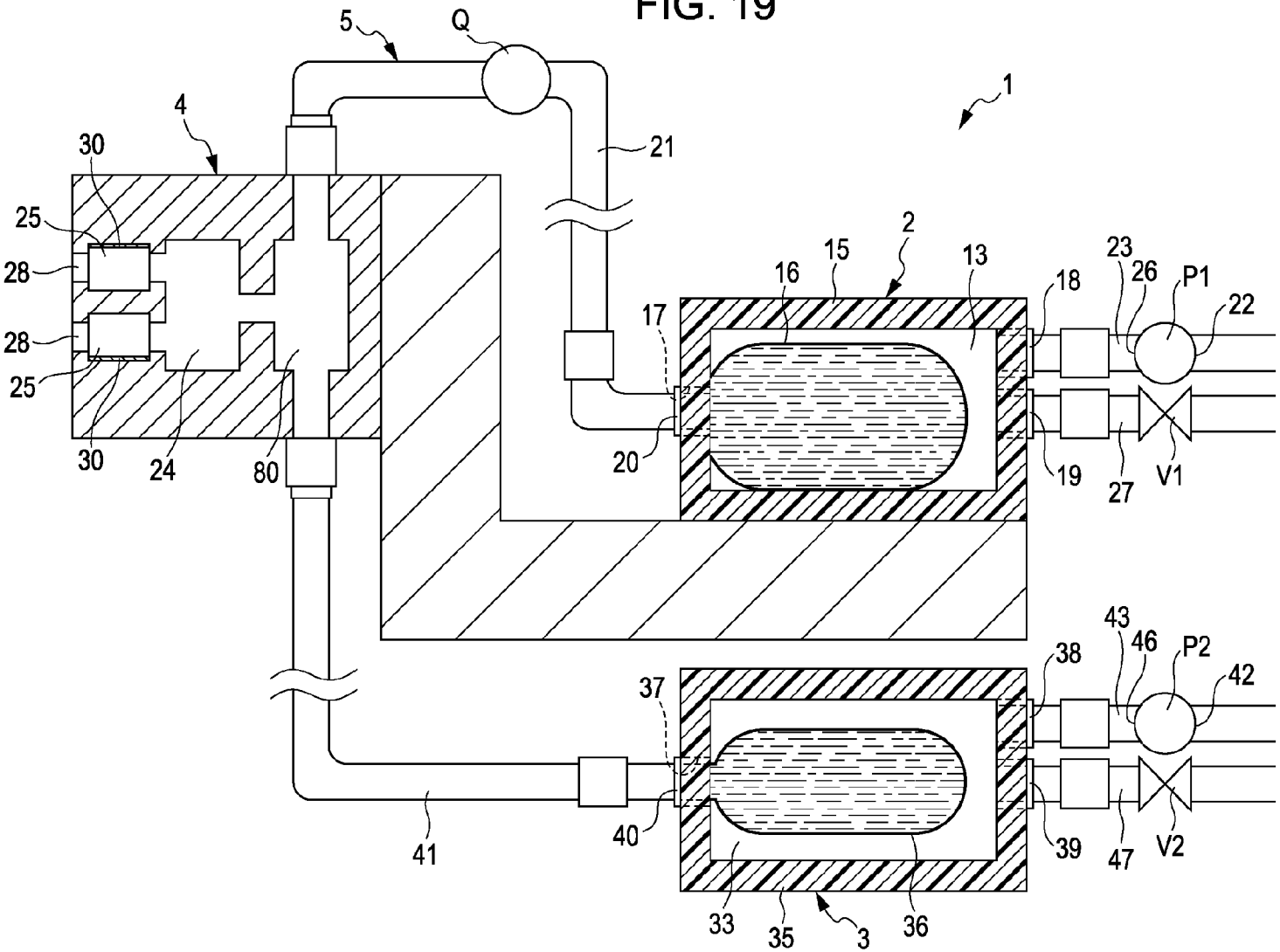
FIG. 19 is a cross-sectional view of an ink tank, an ink cartridge and a head according to a twelfth embodiment of the invention.

As shown in FIG. 19, the head 4 may include a sub-tank 80 communicating with ink passages 21 and 41, an ink chamber 24 communicating with the sub-tank 80, a pressure chamber 25 communicating with the ink chamber 24, a nozzle 28 communicating with the pressure chamber 25, and an actuator 30. In other words, the communication passage 5 is constituted by the ink passage 21 of the tank 2 side for communicating the tank 2 with the sub-tank 80, the ink passage 41 of the cartridge 3 side for communicating the cartridge 3 with the sub-tank 80, and the sub-tank 80 serving as the ink passage for communicating the ink passage 21 of the tank 2 side with the ink passage 41 of the cartridge 3 side, so that the communication passage 5 and the ink chamber 24 are disposed in parallel with each other. With the configuration, since the printer device includes the sub-tank 80, a storage amount of the ink in the head 4 can be increased, and continuous printing time can be extended.

Embodiment 13

Figure 20:
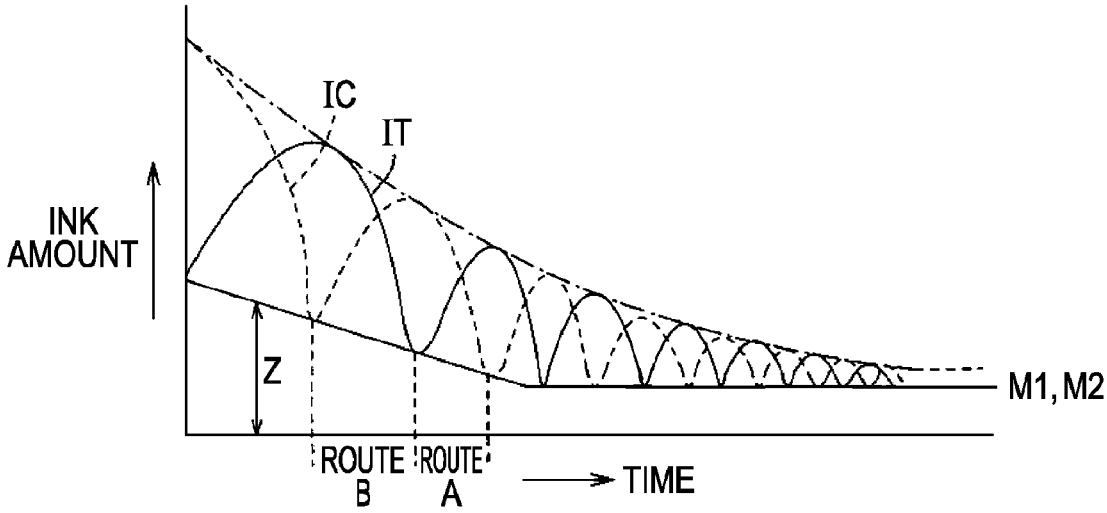
FIG. 20 is a view showing a relation between a fluctuation of a remaining amount of ink and an output of a flow sensor according to the thirteenth embodiment of the invention.

In the control explained in FIG. 12 (the sixth embodiment), the reference values M1 and M2 may be set in such a way that the values are gradually decreased with the lapse of time of the ink usage, as shown in FIG. 20. Therefore, a reciprocal switching number of the forward path route A and the return path route B can be increased, and the agitation effect of the ink can be improved in the initial time period of the ink ejection. In other words, like immediately after the cartridge 3 is exchanged, it is possible to suppress reduction in the number of the replenishing operations of the ink which is carried out between the tank 2 and the cartridge 3, even though the total amount of the ink contained in the tank 2 and the cartridge 3 is relatively large. Also, if the total amount of the ink contained in the tank 2 and the cartridge 3 is decreased with the consumption of the ink, the amount of the ink remaining in the tank 2 or the cartridge 3 is set to be gradually decreased upon the replenishing operation of the ink. Therefore, the agitating operation of the ink can be surely carried out by the reciprocating operation of the ink between the tank 2 and the cartridge 3.

The tank 2 may be adapted to be detachably (exchangeably) attached to the body of the printer device 1.

The flow sensor Q may be installed to any one of the ink passage 21 of the tank 2 side and the ink passage 41 of the cartridge 3 side, or to both the ink passage 21 of the tank 2 side and the ink passage 41 of the cartridge 3 side.

Also, the empty state of the tank 2 and the cartridge 3 means that the ink is not replenished by pressurizing the pumps P1 and P2. Therefore, even though a few droplets of the ink remain in the tank 2 and the cartridge 3, it may be regarded as the empty state. Accordingly, it contains the empty state and the near empty state.

The weight of the ink may be measured by a weight sensor detecting an amount of the ink (liquid amount) filled in the tank 2 and the cartridge 3 and outputting an analog signal.

The control of reciprocal replenishment may be carried out by using any one of the pulses Pa and Pb or any one of the analog signals ITa and ICa.

In the above-described embodiments, although the printer device of an inkjet type is exemplified, the invention may be embodied as a liquid ejecting apparatus that ejects or discharges a liquid other than ink, and a liquid vessel filled with the liquid. The invention can be utilized in various liquid ejecting apparatuses including a liquid ejecting head for ejecting very small quantity of droplets. The droplet unit a state of the liquid to be ejected from the liquid ejecting apparatus, and includes a granular type, a tear-drop type, and a filamentary type with a trail. The liquid mentioned herein may be a material which can be ejected by the liquid ejecting apparatus. For example, it is appropriate that the substance is a fluid state, and it includes a fluid state of high or low viscosity, sol, gel water, other inorganic solvent, organic solvent, solution, liquid resin, a flowage state such as liquid metal (metal melt), not only a liquid having one state of substance, but also a liquid having solid particles, such as dye or metal particle, which are dissolved, dispersed or mixed with a solvent. Also, as described in the above embodiments, a typical example of the liquid is the ink or liquid crystal. The ink includes various liquid compositions, such as aqueous ink, oil-based ink, gel ink, hot melt ink or the like. For example, the liquid ejecting apparatus may be a liquid ejecting apparatus that ejects a liquid in which a material such as an electrode material or a color material, which is used for manufacturing a liquid crystal display, an EL (electroluminescent) display, a surface emitting display or a color filter, is dispersed or dissolved, a liquid ejecting apparatus for ejecting a biological organic substance which can be used to fabricate a biochip, a liquid ejecting apparatus that is used as a precision pipette to discharge a liquid to be used to test materials, a printing apparatus, a micro dispenser, and so forth. Furthermore, the liquid ejecting apparatus may be a liquid ejecting apparatus that ejects a lubricant at pinpoints of precision machines, such as a watch or a camera, a liquid ejecting apparatus that ejects a transparent resin liquid, such as an ultraviolet curing resin on the substrate, for forming a microscopic semi-spherical lens (optical lens) used for an optical communication element, a liquid ejecting apparatus that sprays an acid or alkaline etching solution to etch substrates or the like, and so forth. The invention may be applied to a type of the ejecting apparatus described above.

What is claimed is:

1. A liquid ejecting apparatus comprising:

a first liquid containing unit containing a liquid therein;

a second detachable liquid containing unit containing a liquid therein and having a liquid containing volume smaller than that of the first liquid containing unit;

a communication passage that communicates the first liquid containing unit with the second liquid containing unit, in which the first liquid containing unit and the second liquid containing unit are reciprocally replenished with the liquid via the communication passage;

a liquid replenishing unit that replenishes the liquid between the first liquid containing unit and the second liquid containing unit via the communication passage; and a control unit that, when the liquid is replenished from any one of the first and second liquid containing units to the other, controls the liquid replenishing unit to replenish the liquid from the first liquid containing unit to the second detachable liquid containing unit and from the second detachable liquid containing unit to the first liquid containing unit, until the liquid contained in the one liquid containing unit reaches a predetermined amount smaller than the liquid containing volume of the second liquid containing unit.

2. The liquid ejecting apparatus according to claim 1, wherein while the liquid replenishing unit replenishes the liquid between the respective liquid containing units, the control unit judges whether or not the liquid filled in the one liquid containing unit is the predetermined amount, and controls the liquid replenishing unit based on the judged result.

3. The liquid ejecting apparatus according to claim 1, wherein while the liquid replenishing unit replenishes the liquid between the respective liquid containing units, and a number of replenishments reaches a predetermined number or reciprocal replenishments reaches a predetermined time, the control unit judges whether or not the liquid filled in the one liquid containing unit is the predetermined amount, and controls the liquid replenishing unit based on the judged result.

4. The liquid ejecting apparatus according to claim 1, wherein while the liquid replenishing unit replenishes the liquid between the respective liquid containing units, the control unit controls the liquid replenishing unit in such a way that a desired amount of replenishments after a number of replenishments reaches a predetermined number is less than the desired amount of replenishments before the number of the replenishments reaches the predetermined number.

5. The liquid ejecting apparatus according to claim 1, wherein the control unit controls the liquid replenishing unit in such a way that the predetermined amount is gradually decreased in accordance with consumption of the liquid.

6. The liquid ejecting apparatus according to claim 1, wherein the control unit controls the liquid replenishing unit in such a way that the predetermined amount in the case where the first liquid containing unit replenishes the second liquid containing unit with the liquid differs from the predetermined amount in the case where the second liquid containing unit replenishes the first liquid containing unit with the liquid.

7. A liquid ejecting apparatus comprising:

a first liquid containing unit containing a liquid therein;

a second detachable liquid containing unit containing a liquid therein and having a liquid containing volume smaller than that of the first liquid containing unit;

a communication passage that communicates the first liquid containing unit with the second liquid containing unit, in which the first liquid containing unit and the second liquid containing unit are reciprocally replenished with the liquid via the communication passage;

a liquid replenishing unit that replenishes the liquid between the first liquid containing unit and the second liquid containing unit via the communication passage;

a control unit that controls replenishment from the first liquid containing unit to the second detachable liquid containing unit and from the second detachable liquid containing unit to the first liquid containing unit, wherein when the liquid is replenished from any one of the first and second liquid containing units to the other, the control unit controls the liquid replenishing unit to replenish the liquid from the one liquid containing unit to the other liquid containing unit until the liquid contained in the one liquid containing unit reaches a predetermined amount smaller than the liquid containing volume of the second liquid containing unit;

a detecting unit that detects an amount of the liquid contained in the liquid containing unit of any one of the first liquid containing unit and the second liquid containing unit, or an amount of the liquid flowing through the communication passage; and a judging unit that judges the total amount of the liquid filled in the respective liquid containing units based on an output of the detecting unit, wherein the control unit performs stop control of operation of reciprocal replenishment based on a judged result of the judging unit, and in the stop control, the operation is stopped in a state where the liquid remains in any liquid containing unit of the first liquid containing unit and the second liquid containing unit.

8. The liquid ejecting apparatus according to claim 7, wherein the control unit transfers the liquid contained in the second liquid containing unit to the first liquid containing unit immediately after the operation of reciprocal replenishment stops or after the operation of reciprocal replenishment stops, so that the liquid contained in the second liquid containing unit becomes an empty state or a near empty state.

* * * * *